US008766894B2

(12) United States Patent
Park et al.

(10) Patent No.: US 8,766,894 B2
(45) Date of Patent: Jul. 1, 2014

(54) SIGNAL PROCESSING DEVICE FOR LIQUID CRYSTAL DISPLAY PANEL AND LIQUID CRYSTAL DISPLAY INCLUDING THE SIGNAL PROCESSING DEVICE

(71) Applicant: Samsung Display Co., Ltd., Yongin (KR)

(72) Inventors: Bong-Im Park, Cheonan-si (KR); Jong-Hyon Park, Cheonan-si (KR); Bong-Ju Jun, Cheonan-si (KR); Jae-Won Jeong, Seoul (KR); Yong-Jun Choi, Cheonan-si (KR); Woo-Chul Kim, Seoul (KR); Byung-Kil Jeon, Anyang-si (KR); Nam-Gon Choi, Asan-si (KR); Yun-Jae Kim, Asan-si (KR); Dong-Beom Cho, Asan-si (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 13/767,781

(22) Filed: Feb. 14, 2013

(65) Prior Publication Data

US 2013/0155129 A1 Jun. 20, 2013

Related U.S. Application Data

(60) Continuation of application No. 13/493,776, filed on Jun. 11, 2012, now Pat. No. 8,378,943, which is a division of application No. 12/329,144, filed on Dec. 5, 2008, now Pat. No. 8,217,875.

(30) Foreign Application Priority Data

Jun. 12, 2008 (KR) ..... 10-2008-0055353
Jun. 12, 2008 (KR) ..... 10-2008-0055356

(51) Int. Cl.
*G09G 3/36* (2006.01)

(52) U.S. Cl.
USPC ..... 345/89; 345/690

(58) Field of Classification Search
USPC ..... 345/89, 690
See application file for complete search history.

(56) References Cited

U.S. PATENT DOCUMENTS 7,436,382 B2 * 10/2008 Okuda et al. ..... 345/89
7,688,304 B2 3/2010 Park
7,839,375 B2 11/2010 Lee et al.
7,916,106 B2 3/2011 Kim (Continued)

FOREIGN PATENT DOCUMENTS

JP 2002-229521 8/2002
KR 10-2004-0054544 A 6/2004

(Continued)

*Primary Examiner* — Kwang-Su Yang
(74) *Attorney, Agent, or Firm* — Innovation Counsel LLP

(57) ABSTRACT

A liquid crystal display system including a signal processing device uses interpolation to generate an intermediate image frame using previous image frame data and present image frame data. The system converts data of the intermediate image frame into transposed image data that is to be used to drive a liquid crystal display panel and display a corresponding image. The transposed image data and the present image data are subjected to a prespecified DCC process (dynamic capacitance compensation process) to thereby generate respective first and second compensation image data. Since the first compensation image data is generated based on the transposed image data and the transposition is configured to prevent over-compensation by the DCC process, over-compensation by the dynamic capacitance compensation process can be reduced or prevented.

8 Claims, 16 Drawing Sheets

(56) References Cited

U.S. PATENT DOCUMENTS

| | | | | |
|---|---|---|---|---|
| 8,031,147 | B2 * | 10/2011 | Jeon et al. | 345/89 |
| 2005/0001802 | A1 | 1/2005 | Lee | |
| 2005/0068343 | A1 | 3/2005 | Pan et al. | |
| 2009/0128586 | A1 | 5/2009 | Ahn et al. | |

FOREIGN PATENT DOCUMENTS

| | | | |
|---|---|---|---|
| KR | 10-2006-0124952 | A | 12/2006 |
| KR | 10-2007-0080043 | A | 8/2007 |
| KR | 20070102882 | A | 10/2007 |

* cited by examiner

SIGNAL PROCESSING DEVICE FOR LIQUID CRYSTAL DISPLAY PANEL AND LIQUID CRYSTAL DISPLAY INCLUDING THE SIGNAL PROCESSING DEVICE

CROSS-REFERENCE TO RELATED APPLICATION

This application is a continuation application of U.S. patent application Ser. No. 13/493,776 filed on Jun. 11, 2012, which is a divisional application of U.S. patent application Ser. No. 12/329,144 filed on Dec. 5, 2008 (now U.S. Pat. No. 8,217,875), which claims priority to and the benefit of Korean Patent Application No. 10-2008-0055356 filed on Jun. 12, 2008 and Korean Patent Application No. 10-2008-0055353 filed on Jun. 12, 2008, the entire contents of the prior applications being incorporated herein by reference.

BACKGROUND

1. Field of Invention

The present disclosure of invention relates to a signal processing device for a liquid crystal display and to a liquid crystal display having the same. More particularly, the present disclosure relates to a signal processing device having improved response speed.

2. Description of Related Technology

In general, a liquid crystal display (LCD) displays images using liquid crystals as optical shutters. However, since the liquid crystal display is a shutter-state holding-type display device, when moving images are to be displayed a blurring phenomenon can occur in which sharpness images of moving objects becomes low or the moving objects appear blurred or not transitioning smoothly from one location to a next.

In order to compensate for the slow response speed of the liquid crystals, a dynamic capacitance compensation (DCC) scheme has been developed.

FIGS. 1 and 2 are magnitude versus time waveform diagrams showing a conventional dynamic capacitance compensation scheme.

Referring to FIG. 1, image data of a previous frame, N−1 corresponds to a first to-be-attained or target voltage V1. Image data of a present frame, N corresponds to a second target voltage V2 higher than the first target voltage V1. In case that a voltage difference between the first and second target voltages V1 and V2 is larger than a predetermined reference value, although the second target voltage V2 is to be ultimately applied to the liquid crystals to achieve a corresponding target brightness L, that desired level L will not be immediately achieved by the liquid crystal display in frame N if just V2 is applied due to the slow response speed of the liquid crystals (represented by dashed option "A"). FIG. 1 shows an example where the target brightness level L will be achieved by the liquid crystal display only after about two frames if just V2 is applied (per dashed option "A"). The DCC scheme temporarily over-drives beyond the second target voltage V2, by using a slowness compensating voltage Vc that is higher than the second target voltage V2. Accordingly, when the over-driven compensation voltage Vc is applied to the liquid crystals during the present frame N, so that a crystal response time is shortened, thereby achieving the desired target brightness level L within one frame (the rise curve "B" shown in frame N).

However, as shown in FIG. 2, when the over-driven compensation voltage Vc is applied to the liquid crystals in a present frame, N while the brightness of the previous frame N−1 had not yet reached an earlier, first target brightness level, L1 corresponding to an earlier first target voltage (far below V2 and Vc), errors in crystal state accumulate and an excessive next brightness level, L3 is produced which is larger than the desired second target brightness level, L2. That is, although the DCC scheme is performed normally, in some cases an inordinate compensation voltage Vc is applied to the liquid crystals in the present frame N. As a result, an excessive brightness may be visually recognized (perceived) during the following present and next frames, N and N+1.

SUMMARY

An exemplary embodiment in accordance with the present disclosure of invention provides a signal processing device for a liquid crystal display panel having improved response speed and better attainment of the desired liquid crystal shutter states.

In one exemplary embodiment, a signal processing device for a liquid crystal display panel includes a motion interpolator, a look-up table (LUT), a memory, and a data compensator. The motion interpolator calculates a motion vector of a prespecified object in the image using previous image data of a previous frame and present image data of a present frame and generates an interpolated intermediate image data for insertion as an intermediate sub frame based on the motion vector. The look-up table stores predetermined transposition data that may be used to smooth out differences between the previous frame, the intermediate sub frame and the present frame. The look-up table (LUT) generates transposed target gray scale values based on an input combination of the previous image data and the intermediate image data and the LUT outputs the corresponding first transposed image data. The memory stores the present image data and the first transposed image data and sequentially outputs the first transposed image data and the present image data for compensation during the present frame. The data compensator receives the first transposed image data and the present image data from the memory. The data compensator generates compensation data for the first transposed image data where the latter is used to generate a first compensation image data. The data compensator also generates compensation data for the present image data where the latter is used to generate a second compensation image data, and thereby compensate response characteristics of the liquid crystal display panel based on the first and second compensation image data.

In another exemplary embodiment, a liquid crystal display includes a signal processing device, a data driver, a gate driver, and a liquid crystal display panel. The signal processing device receives a previous image data of a previous frame and a present image data of a present frame and sequentially outputs a first compensation image data and a second compensation data. The data driver outputs the first compensation data voltage in response to the first compensation image data during a first sub-frame of the present frame and outputs the second compensation data voltage in response to the second compensation image data during a second sub-frame of the present frame. The gate driver outputs a gate signal. The liquid crystal display panel sequentially displays a first sub-image corresponding to the first compensation data voltage and a second sub-image corresponding to the second compensation data voltage in response to the gate signal.

The signal processing device includes a motion interpolator, a look-up table, a memory, and a data compensator.

The motion interpolator calculates a motion vector by using the previous image data of the previous frame and the present image data of the present frame and generates an intermediate image data based on the calculated motion vector. The look-up table stores a plurality of reference gray scales. The look-up table transposes a target gray scale of the intermediate image data into a first reference gray scale based on a combination of the previous image data and the intermediate image data, and outputs the first reference gray scale as a first transposed image data. The first reference gray scale corresponds to an image displayed on the liquid crystal display panel. The memory stores the present image data and the first transposed image data and sequentially outputs the first transposed image data and the present image data during the present frame. The data compensator receives the first transposed image data and the present image data from the memory. The data compensator performs a compensation process on the first transposed image data to thereby generate the first compensation image data. The data compensator also performs a compensation process on the present image data to thereby generate the second compensation image data, where the compensation process compensates for response characteristics of the liquid crystal display panel and is based on the first and second compensation image data.

According to the above, a blurring phenomenon of the liquid crystal display panel and slowness of the response time of the LCD may be prevented or reduced by insertion of the first sub-image frame into the time period covered by the present frame. In addition, an apparent response speed of the liquid crystal display panel may be improved by using the first and second compensation image data that are compensated by the dynamic capacitance compensation process. Further, the first compensation image data are generated based on the first and second transposed image data corresponding to images displayed on the liquid crystal display panel, so that the first compensation image data may be prevented from being over-compensated.

BRIEF DESCRIPTION OF THE DRAWINGS

The above and other advantages of the present disclosure of invention will become readily apparent by reference to the following detailed description when considered in conjunction with the accompanying drawings wherein.

DETAILED DESCRIPTION

Hereinafter, embodiments in accordance with the disclosure will be explained in detail with reference to the accompanying drawings.

Figure 1:
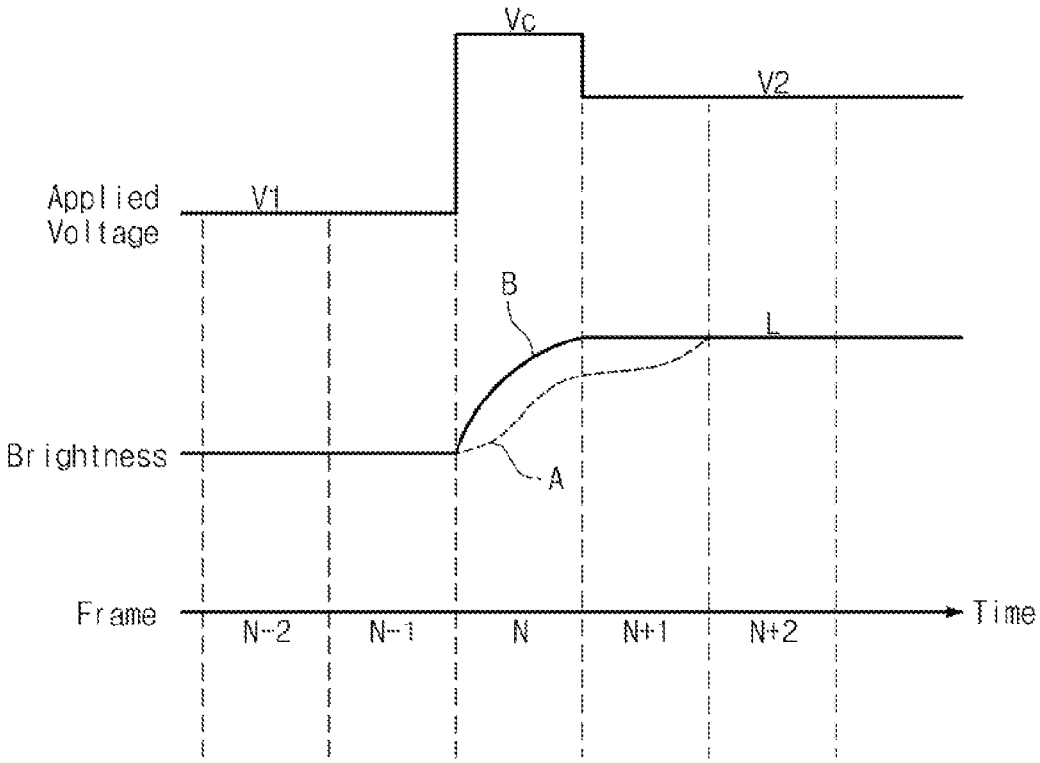
Fig. 1 (PRIOR ART)
FIGS. 1 and 2 are waveform diagrams showing a conventional dynamic capacitance compensation (DCC) scheme.
Figure 2:
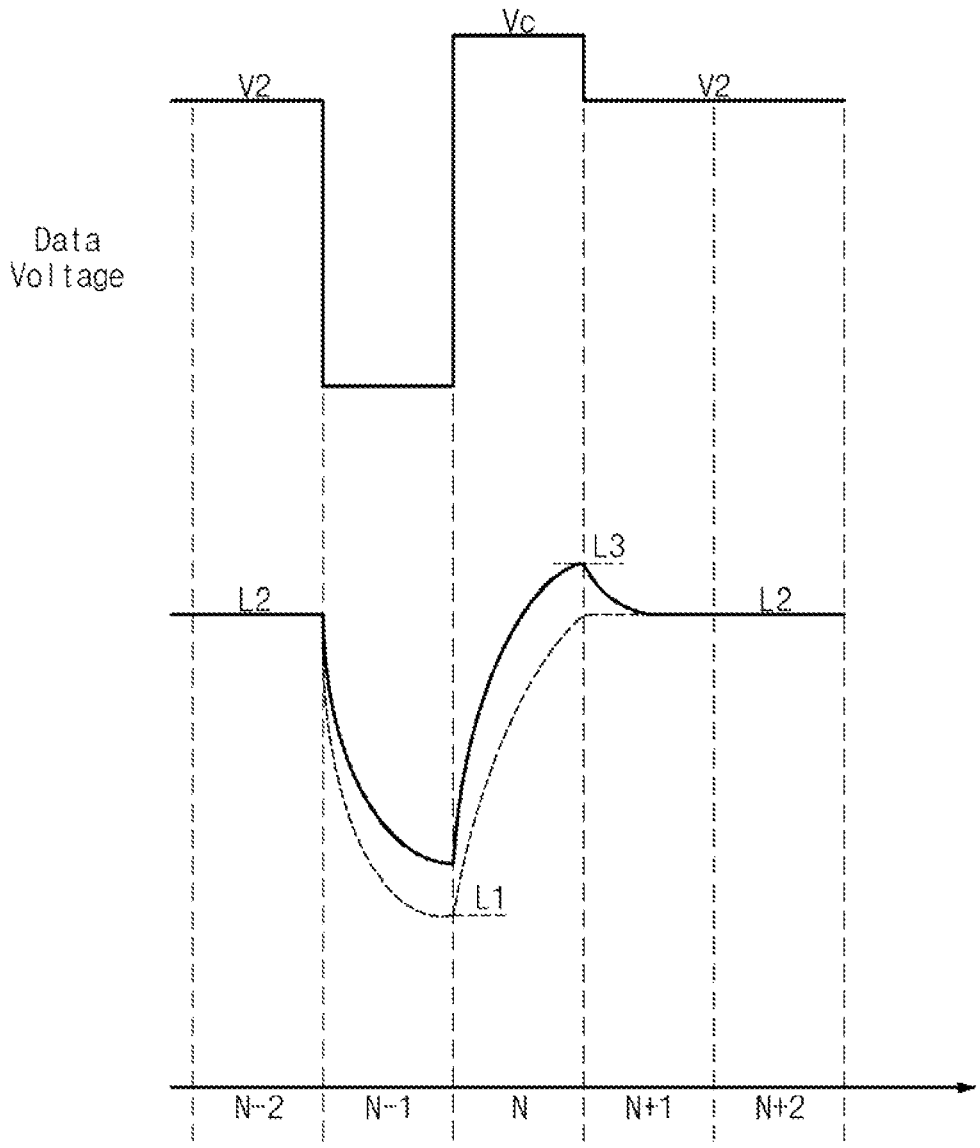
Fig. 2 (PRIOR ART)
Figure 3:
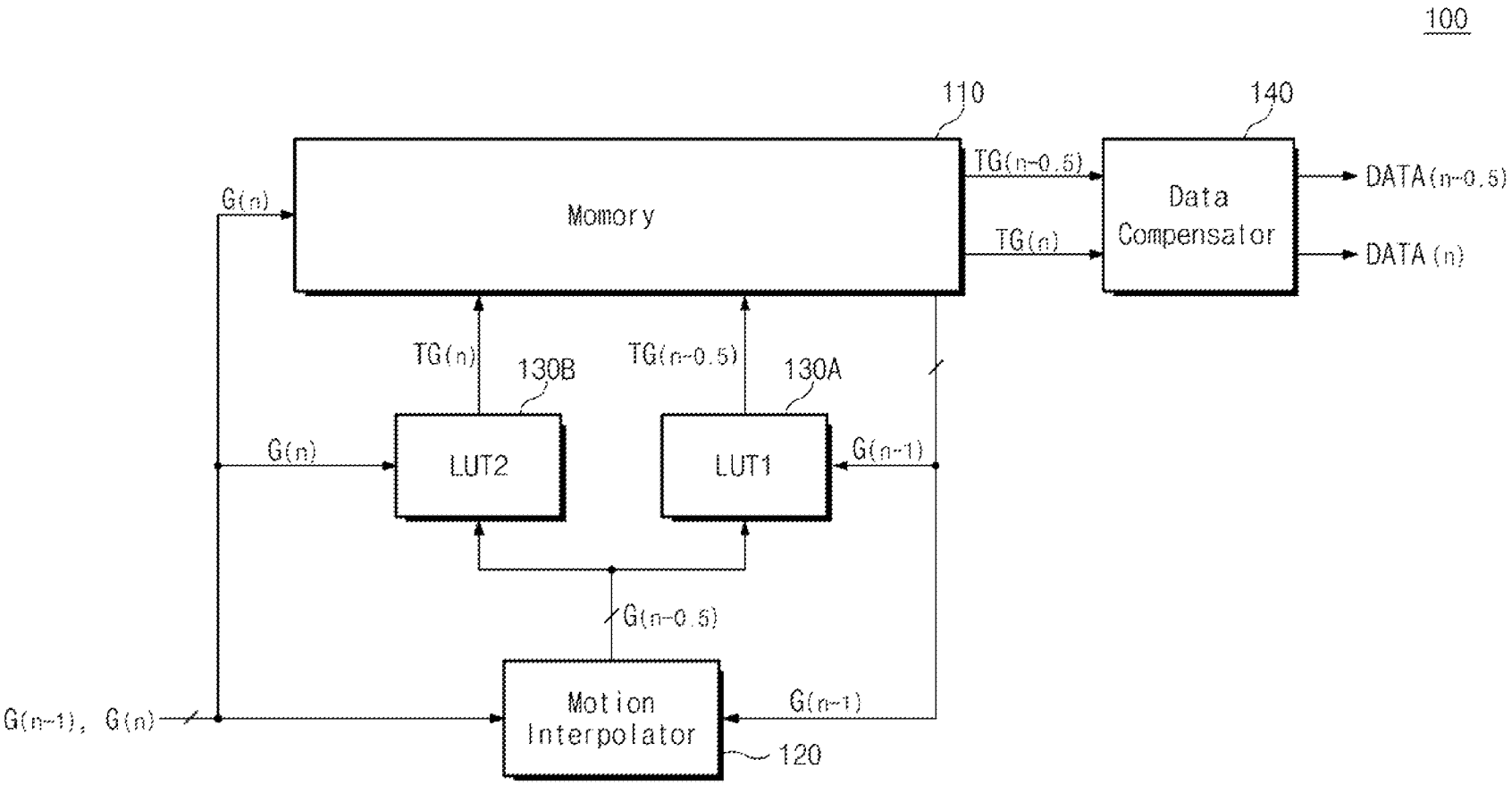
FIG. 3 is a block diagram showing an exemplary embodiment of a signal processing device according to the disclosure.
Figure 4:
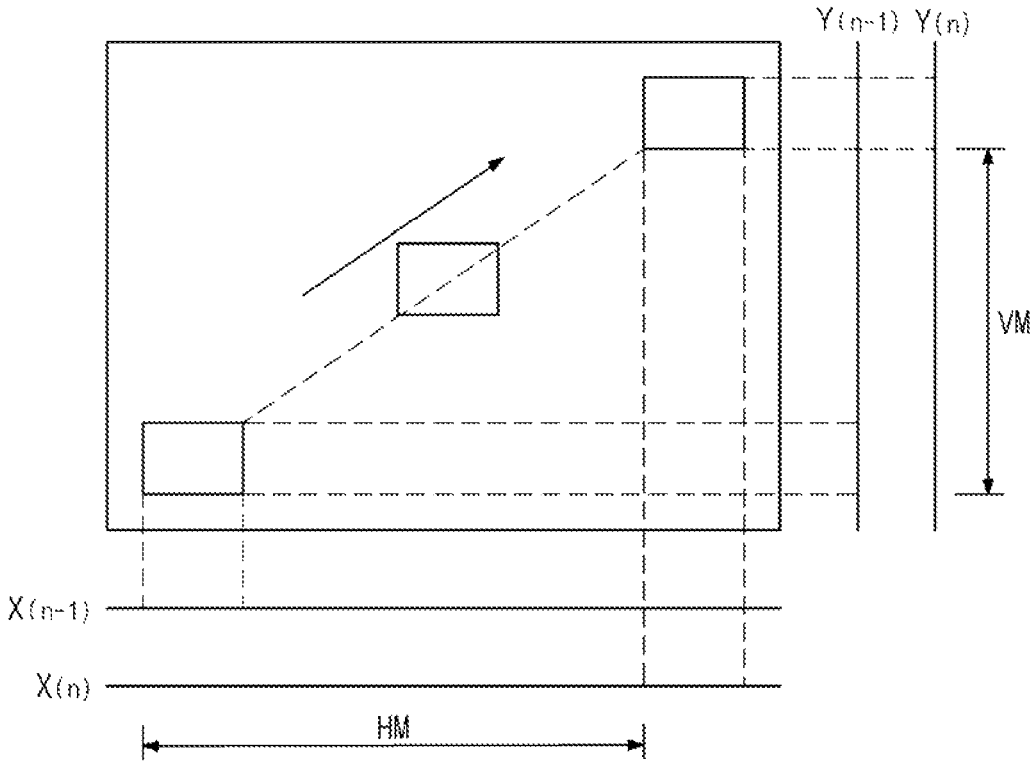
FIG. 4 is a view showing a method of calculating a motion vector in a motion interpolator shown in FIG. 3.

FIG. 3 is a block diagram showing an exemplary embodiment of a first signal processing device 100 according to the present disclosure, and FIG. 4 is a view showing a method of calculating a motion vector in a motion interpolator 120 shown in FIG. 3.

Referring to FIG. 3, a signal processing device 100 includes a memory 110, a motion interpolator 120, a first look-up table (LUT1) 130A, a second look-up table (LUT2) 130B, and a data compensator 140.

The memory 110 receives frames of sourced image data (e.g., . . . , G(n−2), G(n−1), G(n), . . . ) displaying a moving picture for example from an external device (not shown) such as a graphics controller. The sourced image data is sequentially stored in the memory 110 such that the data can be retrieved in the same sequence and displayed as successive image frames. In one embodiment, memory 110 includes a plurality of FIFO's (first-in, first-out buffers). When the currently being sourced image data, G(n) (hereinafter, referred to as a present image data corresponding to a present frame number n) is being applied to an input of the memory 110, stored image data G'(n−1) (hereinafter, referred to as a previous image data corresponding to a previous frame and previously stored in the memory) is simultaneously output from the memory 110. The previous image data G'(n−1) output from the memory 110 is applied to the motion interpolator 120 and to the first look-up table 130A while present frame data G(n) is also applied to the motion interpolator 120 and to a second look-up table 130B.

In response to receipt by the motion interpolator 120 of the presently sourced image data G(n) and the previous image data G'(n−1) as retrieved from memory 110, the motion interpolator 120 generates an interpolation-derived, intermediate frame of image data G(n−0.5) corresponding to an intermediate half frame time point using the present image data G(n) and the previous image data G'(n−1). In one embodiment, the motion interpolator 120 calculates a motion vector MV using a luminance component of the present image data G(n) and a luminance component of the previous image data G'(n−1). The motion interpolator 120 generates the intermediate image data G(n−0.5) based on the calculated motion vector MV for a pre-identified object moving within the frames. In particular, the intermediate image data G(n−0.5) is generated by the motion interpolator 120 defined as shown in Equation 1.

$$G(n-0.5) = G'(n-1) + MV \times \frac{1}{2} \qquad \text{Equation 1}$$

whereby the intermediate image data G(n−0.5) is defined as shifted value by an amount equal to half the motion vector MV from the previous image data G(n−1). The generated intermediate image data G(n−0.5) is inserted (e.g., interposed chronologically between others of the frames) so as to follow the displayed present frame even though the intermediate image data G(n−0.5) did not exist in the sourced set of image data frames, (e.g., . . . , G(n−2), G(n−1), G(n), . . . ).

FIG. 4 shows an example where the sourced image frames contain a rectangular object moving from a left lower portion of the display screen toward a right upper portion of the display screen. In FIG. 4, X(n−1) indicates x-axis coordinates of the object in previous frame N−1, X(n) indicates x-axis coordinates of the object in the present frame N, Y(n−1) indicates y-axis coordinates of the previous frame, and Y(n) indicates y-axis coordinates of the present frame.

A horizontal motion vector HM is calculated from a difference between the lowest x-axis coordinate X(n) of the object in the present frame and the lowest x-axis coordinate X(n−1) of the previous frame for example. Also, a vertical motion vector VM is calculated from a difference between the lowest y-axis coordinate Y(n) of the present frame and the lowest y-axis coordinate Y(n−1) of the previous frame. The horizontal motion vector HM includes direction information with respect to an x-axis direction when the image moves, and the vertical motion vector VM includes direction information with respect to an y-axis direction when the image moves. When the horizontal motion vector HM and the vertical motion vector VM are calculated, a motion estimation process is performed by using the calculated horizontal and vertical motion vectors HM and VM. The motion interpolator 120 estimates a moving path of the imaged object as displayed on the display screen through the motion estimation process and generates the intermediate frame of image data G(n−0.5) to allow the inserted/added frame of intermediate image data to be chronologically positioned at the half frame position of the estimated moving path. Thus, by inserting intermediate frames between originally sourced frames, change between successive frames is reduced and the signal processing device 100 may prevent perception of the blurring or object jumping phenomenon since the intermediate image data G(n−0.5) is inserted chronologically so as to display the moving image at a higher temporal resolution (e.g., more frames per unit of time).

Referring again to FIG. 3, the first look-up table 130A stores a first plurality of predefined gray scale transpositions. The previous image data G'(n−1) from the memory 110 and the intermediate image data G(n−0.5) from the motion interpolator 120 are applied to the first look-up table 130A as read addresses. The first look-up table 130A outputs corresponding first transposed signals representing a first transposed frame of image data TG(n−0.5), which data is obtained by mapping so as to produce smoothed out data between the previous image frame data G'(n−1) and the intermediate image data G(n−0.5) where the smoothing is produced by the predefined gray scale transpositions in LUT1 (130A). That is, if the previous image data sample G'(n−1) for the same pixel location is of greater value than the intermediate image data G(n−0.5), the first look-up table 130A outputs a corresponding the transposed image data sample, TG(n−0.5) having a gray scale value greater than the intermediate image data G'(n−0.5) so as to reduce the amount of change. On the other hand, if the previous image data G'(n−1) is smaller than the interpolated intermediate image data G(n−0.5) for the same pixel location, the first look-up table 130A outputs the first transposed image data sample TG(n−0.5) as having a gray scale value smaller than the intermediate image data G'(n−0.5) so as to thereby reduce the amount of change. The amount of change downscaling that is applied to the intermediate image data G(n−0.5) by the first look-up table 130A is empirically predetermined by use of experiments that look for best fit mapped smoothing of changes so they are not too abrupt and yet provide acceptable half frame image data. The empirically determined change downscaling values are stored in corresponding read addresses of the first look-up table 130A as reference data.

The second look-up table 130B stores a second plurality of change reducing or smoothing values. The presently sourced image data G(n) (e.g., from the external device) and the intermediate image data G(n−0.5) from the motion interpolator 120 are applied to the second look-up table 130B as read addresses. The second look-up table 130B outputs the second transposed image data signals TG(n), which are obtained by mapping the present image data G(n) and the intermediate image data G(n−0.5) so as to smooth out changes between the two. That is, if the intermediate image data G(n−0.5) is greater than the present image data G(n) at a given pixel location, the second look-up table 130B outputs the second transposed image data TG(n) having a gray scale value greater than the present image data G(n) so as to thereby reduce the amount of relative change seen when switching form the G(n−0.5) image frame to that of the later in time G(n) image frame. On the other hand, if the intermediate image data G(n−0.5) is smaller than the present image data G(n) at a given pixel location, the second look-up table 130B outputs the second transposed image data TG(n) as having a gray scale value smaller than the present image data G(n) so as to thereby reduce the amount of relative change seen when switching form the G(n−0.5) image frame to that of the later in time G(n) image frame. Smoothing values used in the second look-up table 130B are empirically determined in similar manner to those of LUT 130A.

The first and second transposed image data TG(n−0.5) and TG(n) are output from the first and second look-up tables 130A and 130B, respectively, and are stored into the memory 110 (e.g., into respective FIFO's, not shown within memory 110). The memory 110 sequentially outputs the stored first and second transposed image data, TG'(n−0.5) and TG'(n) for a present frame in response to image fetch control signals of a memory controller (not shown).

More specifically, a sourced present frame may be chronologically split into a first-sub frame and a second-sub frame, which are successive in time. The first sub-frame may have a same duration as or a different duration from the second sub-frame. In the present exemplary embodiment, the first sub-frame has the same duration as the second sub-frame. Accordingly, the memory 110 outputs the first transposed image data TG(n−0.5) during the first sub-frame and outputs the second transposed image data TG(n) during the second sub-frame.

The data compensator 140 compensates the first and second transposed image data TG(n−0.5) and TG(n) using the dynamic capacitance compensation (DCC) process. In detail, the first transposed image data TG(n−0.5) is applied to the data compensator 140 during the first sub-frame and the second transposed image data TG(n) is applied to the data compensator 140 during the second sub-frame. The data compensator 140 compensates the first transposed image data TG(n−0.5) to output first DCC compensated image data DATA(n−0.5) during the first sub-frame, and compensates the second transposed image data TG(n) to second DCC compensated image data DATA(n) during the second sub-frame.

Accordingly, the liquid crystal display panel is driven to display a first sub-image corresponding to the first compensation image data DATA(n−0.5) during the first sub-frame and it is driven to display a second sub-image corresponding to the second compensation image data DATA(n) during the second sub-frame.

Since the changes between sub frames is less than changes between sourced frames, the DCC compensator 140 is less likely to over compensate and thus, the signal processing device 100 as the above-described may prevent the blurring phenomenon of the liquid crystal display panel by using the first sub-image inserted chronologically after the present frame.

In addition, the signal processing device 100 may improve a response speed of the liquid crystal display panel using the first and second compensation image data DATA(n−0.5) and DATA(n) that are compensated by the dynamic capacitance compensation process.

Further, the first and second compensation image data DATA(n−0.5) and DATA(n) are generated based on the first and second transposed image data TG(n−0.5) and TG(n) corresponding to images displayed on the liquid crystal display panel. Thus, the first and second compensation image data DATA(n−0.5) and DATA(n) may be prevented from being over-compensated.

Figure 5:
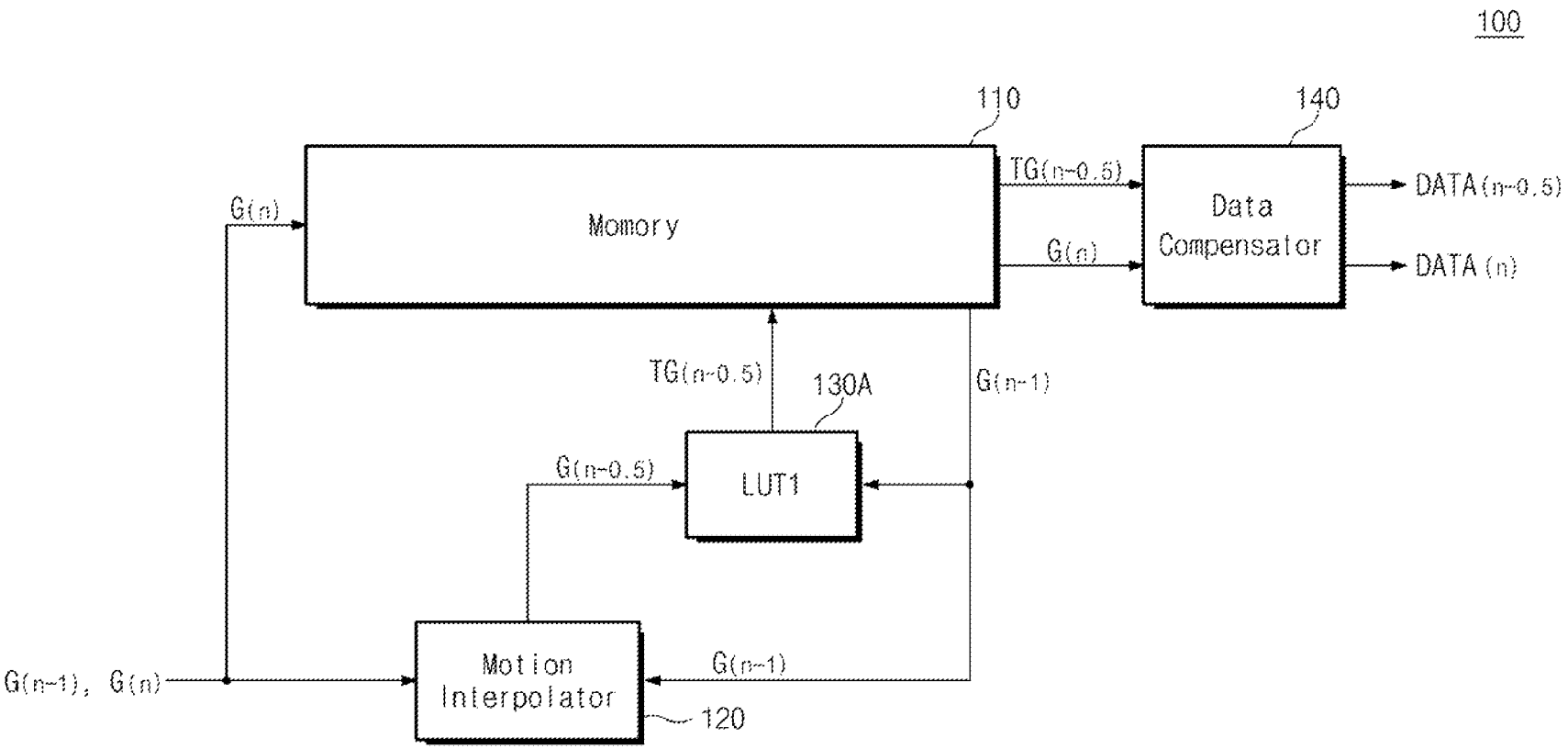
FIG. 5 is a block diagram showing another exemplary embodiment of a signal processing device.

FIG. 5 is a block diagram showing another exemplary embodiment of a signal processing device according to the present disclosure. In FIG. 5, the same reference numerals denote the same elements as in FIG. 3, and thus detailed descriptions of the same elements will be omitted.

Referring to FIG. 5, a signal processing device 100 performs a transposition process only with respect to combination of intermediate image data G(n−0.5) and previous image data G(n−1). That is, in the present exemplary embodiment, only the intermediate image data G(n−0.5) are transposed to reference gray scales corresponding to images that are actually displayed on the liquid crystal display panel. Thus, the signal processing device 100 shown in FIG. 5 requires only one change-smoothing look-up table 130A. As a result, the total memory size of the signal processing device 100 shown in FIG. 5 may be reduced.

Particularly, the signal processing device 100 according to another exemplary embodiment includes a memory 110, a motion interpolator 120, a look-up table 130A, and a data compensator 140.

The memory 110 receives image data from an external device (not shown), and the image data are sequentially stored in the memory 110. When the present image data G(n) are applied to the memory 110, the previous image data G(n−1) previously stored in the memory 110 are output from the memory 110. The previous image data G(n−1) output from the memory 110 are applied to the motion interpolator 120 and the look-up table 130A.

The motion interpolator 120 receives the present image data G(n) from the external device and the previous image data G(n−1) from memory 110. The motion interpolator 120 generates intermediate image data G(n−0.5) using the present image data G(n) and the previous image data G(n−1).

The look-up table 130A stores predefined change smoothing value. The previous image data G(n−1) from the memory 110 and the intermediate image data G(n−0.5) from the motion interpolator 120 are applied to the look-up table 130A as read addresses. The look-up table 130A outputs the smoothed or transposed half frame data TG(n−0.5) by mapping the previous image data G(n−1) and the intermediate image data G(n−0.5).

More specifically, in one present exemplary embodiment, if the previous image data G'(n−1) is greater than the intermediate image data G(n−0.5), the first look-up table 130A outputs the first transposed image data TG(n−0.5) as having a gray scale value greater than the intermediate image data G(n−0.5). On the other hand, if the previous image data G'(n−1) is smaller than the intermediate image data G(n−0.5), the first look-up table 130A outputs the first transposed image data TG(n−0.5) having a gray scale value smaller than the intermediate image data G(n−0.5), thus reducing the abruptness of change between the older image frame G'(n−1) and the later in time interpolated frame G(n−0.5). The transposed image data TG(n−0.5) output from the look-up table 130A are stored into the memory 110 again.

The memory 110 changes a frame presentation frequency of the transposed image data TG(n−0.5) and a frame frequency of the present image data G(n) in response to control signals provided from a memory controller (not shown). That is, the memory 110 sequentially outputs the transposed image data TG(n−0.5) and the present image data G(n), of which the frame frequencies are changed, during the present frame.

The data compensator 140 receives the transposed image data TG(n−0.5) and the present image data G(n), of which the frame frequencies are changed, during the present frame. The data compensator 140 compensates the transposed image data TG(n−0.5) to the first compensation image data DATA (n−0.5) using a dynamic capacitance compensation process and compensates the present image data G(n) to the second compensation image data DATA(n) using the dynamic capacitance compensation process. Accordingly, the signal processing device 100 may improve a response speed of the liquid crystal display panel using the first and second compensation image data DATA(n−0.5) and DATA(n) that are compensated by the dynamic capacitance compensation process.

Figure 6:
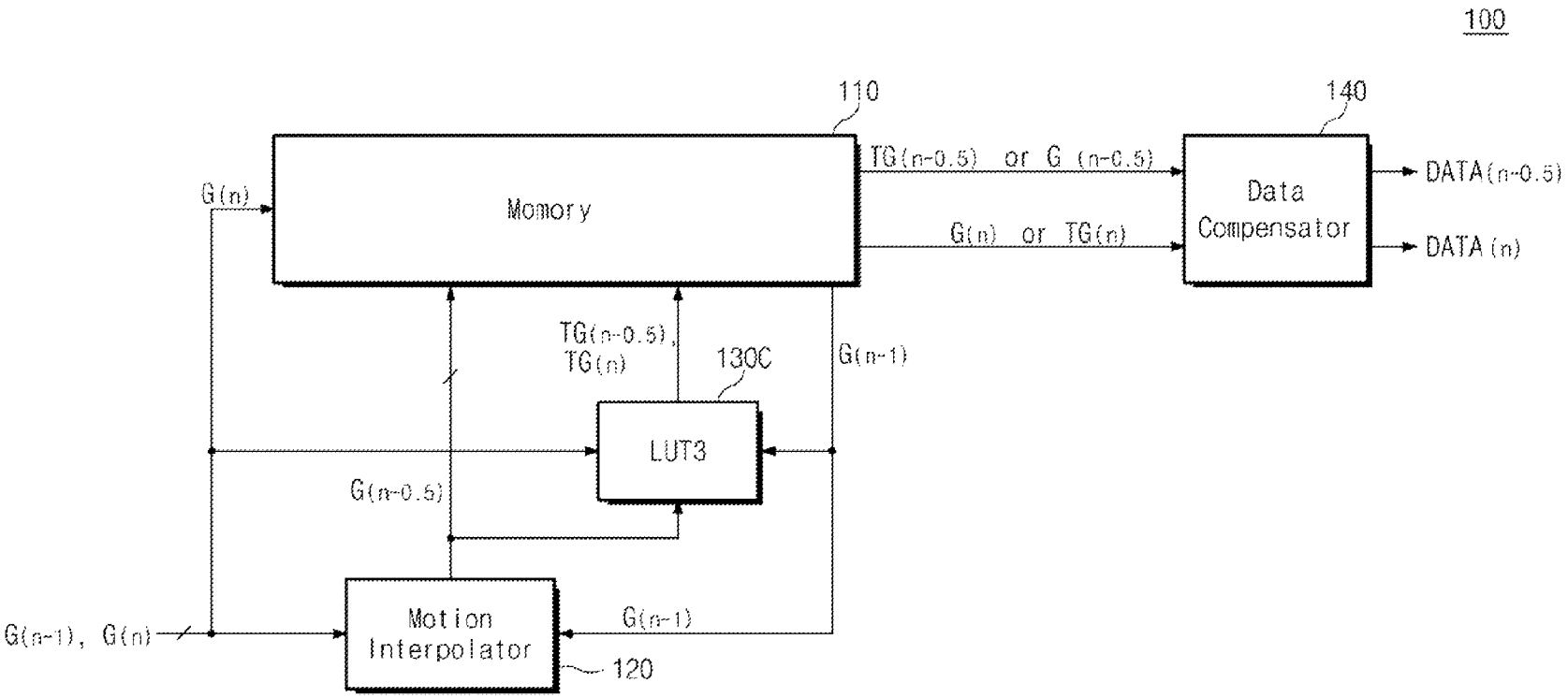
FIG. 6 is a block diagram showing another exemplary embodiment of a signal processing device.

FIG. 6 is a block diagram showing another exemplary embodiment of a signal processing device according to the present invention. In FIG. 6, the same reference numerals denote the same elements shown in FIG. 5, and thus detailed description of the same elements will be omitted.

Referring to FIG. 6, a signal processing device 100 shown in FIG. 6 includes one change smoothing look-up table 130C. Different from the signal processing device 100 shown in FIG. 5, the signal processing device 100 shown in FIG. 6 receives the previous image data G(n−1), the present image data G(n), and applies G(n) to LUT3 (130C) and also the earlier stored G'(n−1) to LUT3. LUT3 (130C) also receives the interpolated G(n−0.5) signal as a third read address. The look-up table 130C can be switched to output either a first transposed image data TG(n−0.5) corresponding to a combination of the previous image data G'(n−1) and the intermediate image data G(n−0.5) or a second transposed image data TG(n) corresponding to a combination of the present image data G(n) and the intermediate image data G(n−0.5). In addition, in the present exemplary embodiment, the memory 110 receives the present image data G(n) and the intermediate image data G(n−0.5), and one of the first and second transposed image data TG(n−0.5) and TG(n) is applied to the memory 110 depending on the selected mode of LUT 130C.

Then, the memory 110 outputs either the first transposed image data TG(n−0.5) or the intermediate image data G(n−0.5) in response to the control of the memory controller (not shown) during the first sub-frame of the present frame, and outputs either the present image data G(n) and the second transposed image data TG(n) during the second sub-frame of the present frame.

Particularly, the memory 110 outputs the first transposed image data TG(n−0.5) during the first sub-frame of the present frame and outputs the present image data G(n) during the second sub-frame of the present frame. In addition, the memory 110 outputs the intermediate image data G(n−0.5) in the first sub-frame and outputs the second transposed image data TG(n) in the second sub-frame.

When the first transposed image data TG(n−0.5) and the present image data G(n) are sequentially applied to the data compensator 140 within the present frame, the data compensator 140 compensates the first transposed image data TG(n−0.5) to output first compensation image data DATA(n−0.5) during the first sub-frame and compensates the present image data G(n) to output second compensation image data DATA (n) during the second sub-frame.

Meanwhile, when the intermediate image data G(n−0.5) and the second transposed image data TG(n) are sequentially applied to the data compensator 140, the data compensator 140 compensates the intermediate image data G(n−0.5) to output the first compensation image data DATA(n−0.5) during the first sub-frame and compensates the second transposed image data TG(n) to output the second compensation image data DATA(n) during the second sub-frame.

Figure 7:
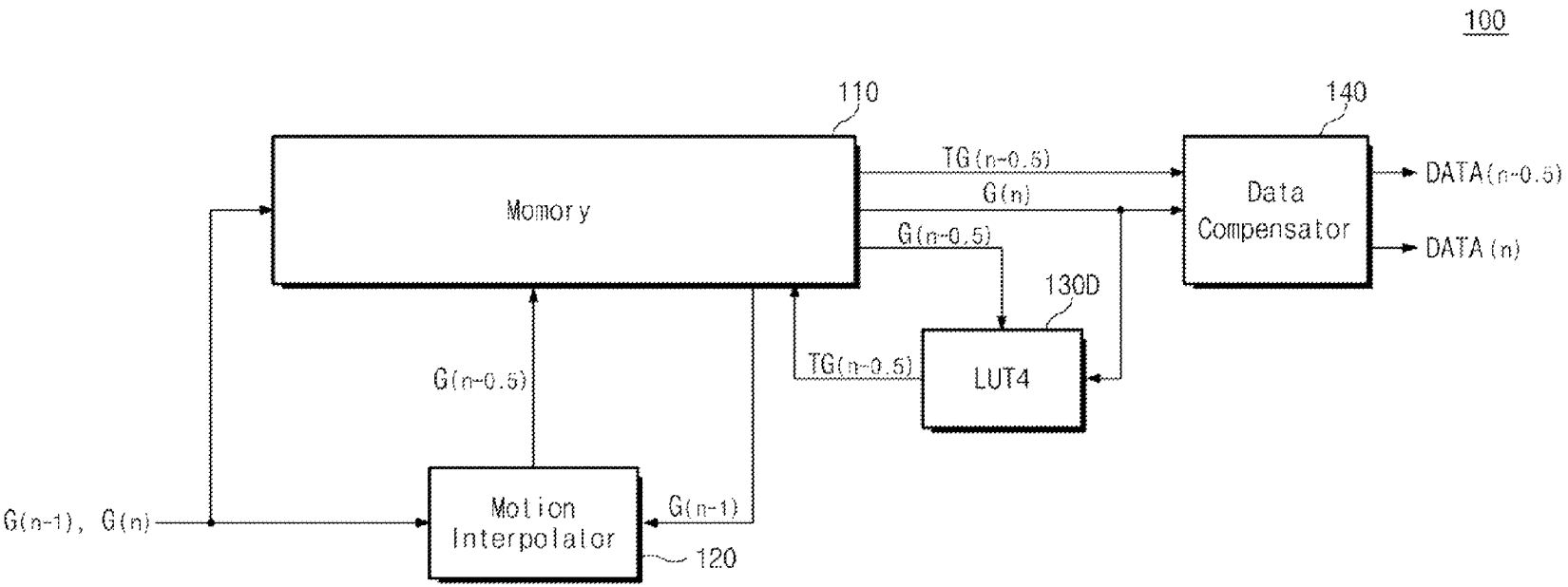
FIG. 7 is a block diagram showing another exemplary embodiment of a signal processing device.

FIG. 7 is a block diagram showing another exemplary embodiment of a signal processing device according to the present disclosure. In FIG. 7, the same reference numerals denote the same elements in FIG. 6, and thus the detailed description of the same elements will be omitted.

Referring to FIG. 7, a signal processing device 100 includes a memory 110, a motion interpolator 120, a look-up table 130D (LUT4), and a data compensator 140.

The memory 110 stores image data sequentially provided from an external device (not shown) therein in a frame unit. When the present image data G(n) are applied to the memory 110, the memory 110 outputs the previous image data G(n−1) previously stored in the memory 110. Also, the memory 110 receives the intermediate image data G(n−0.5) that are generated by and output from the motion interpolator 120.

The motion interpolator 120 receives the present image data G(n) from the external device and the previous image data G'(n−1) from the memory 110 and generates the intermediate image data G'(n−0.5) using the present image data G(n) and the previous image data G'(n−1). The intermediate image data G(n−0.5) generated by the motion interpolator 120 are stored into the memory 110.

The intermediate image data G'(n−0.5) and the present image data G'(n) are applied to the look-up table 130D from the memory 110. The look-up table 130D changes the intermediate image data G(n−0.5) to the first transposed image data TG(n−0.5) based on the combination of the intermediate image data G(n−0.5) and the present image data G(n). The first transposed image data TG(n−0.5) are applied to and stored in the memory 110.

The memory 110 outputs the first transposed image data TG(n−0.5) during the first sub-frame of the present frame and outputs the present image data G(n) during the second sub-frame of the present frame. The first transposed image data TG(n−0.5) and the present image data G(n) output from the memory 110 are applied to the data compensator 140.

Through the dynamic capacitance compensation process, the data compensator 140 compensates the first transposed image data TG(n−0.5) to generate the first compensation image data DATA(n−0.5) and compensates the present image data G(n) to generate the second compensation image data DATA(n).

According to the above-described exemplary embodiments of the signal processing devices, the first compensation image data DATA(n−0.5) are generated within the first sub-frame of the present frame. Thus, the blurring phenomenon of the liquid crystal display panel may be prevented or reduced by use of the first compensation image data DATA(n−0.5).

In addition, the response speed of the liquid crystal display panel may be improved by using the first and second compensation image data DATA(n−0.5) and DATA(n) that are compensated through the dynamic capacitance compensation process.

Further, the first compensation image data DATA(n−0.5) are generated based on the first transposed image data TG(n−0.5) corresponding to images actually displayed on the liquid crystal display panel. Thus, the first compensation image data DATA(n−0.5) may be prevented from being over-compensated.

As described in FIGS. 3, 6 and 7, the second compensation image data DATA(n) may be also prevented from being over-compensated.

Figure 8:
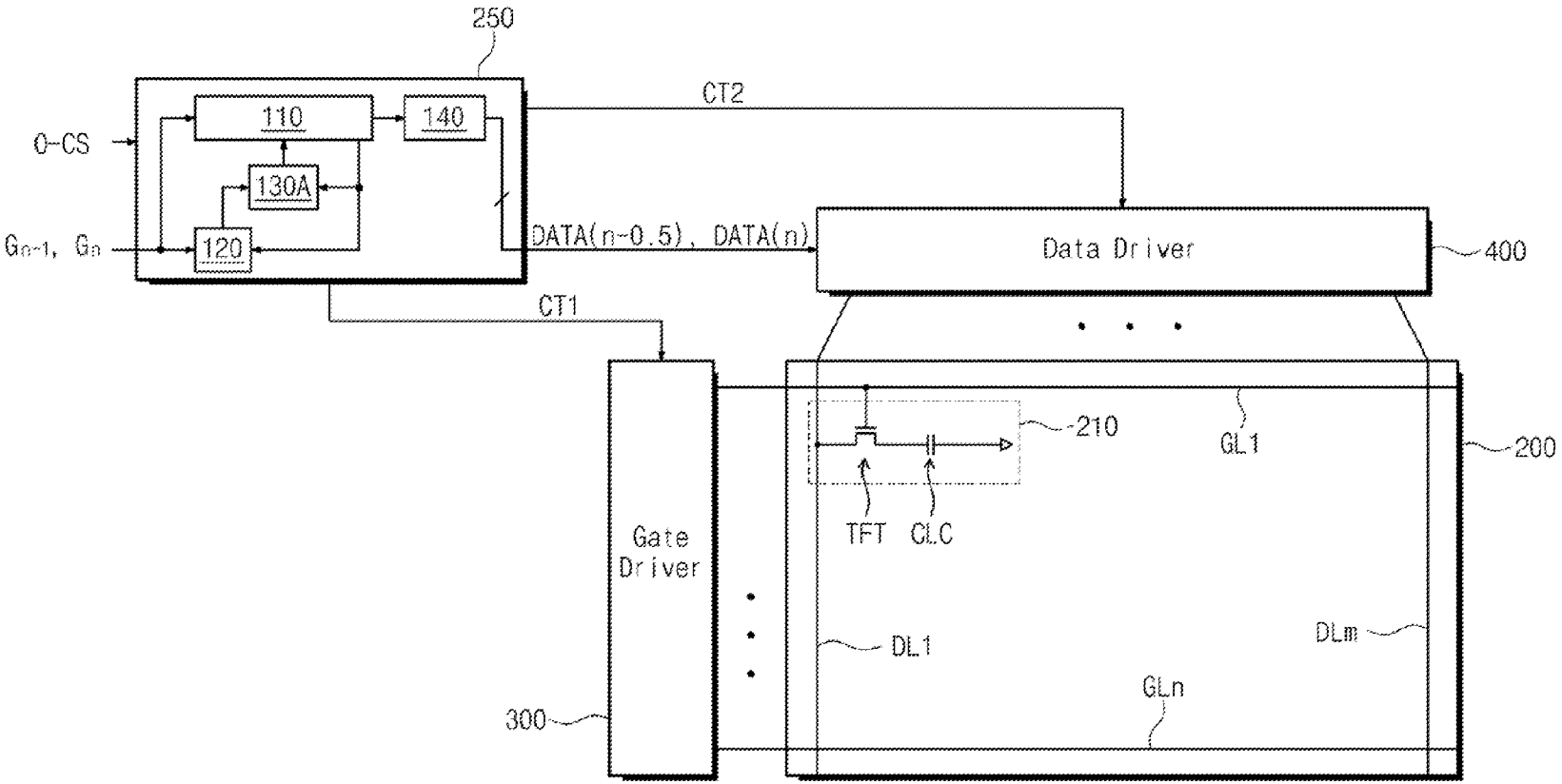
FIG. 8 is a block diagram showing an exemplary embodiment of a liquid crystal display according to the present disclosure.

FIG. 8 is a block diagram showing an exemplary embodiment of a liquid crystal display according to the present disclosure. In FIG. 8, the same reference numerals denote the same elements in FIGS. 3 to 7, and thus detailed description of the same elements will be omitted.

Referring to FIG. 8, a liquid crystal display includes a liquid crystal display panel 200, a gate driver 300, a data driver 400, and a timing controller 250.

The liquid crystal display 200 includes a plurality of gate lines GL1-GLn to which respective gate voltages (typically binary) are applied, a plurality of data lines DL1-DLm to which respective data voltages (typically analog) are applied, and a plurality of pixel areas defined by crossings of the gate lines GL1-GLn and the data lines DL1-DLm in a matrix form. A pixel unit 210 is arranged in each pixel area and includes a thin film transistor TFT and a liquid crystal capacitor CLC.

The gate driver 300 is electrically connected to the gate lines GL1-GLn arranged on the liquid crystal display panel 200 to apply the gate voltage to the gate lines GL1-GLn.

The data driver 400 is electrically connected to the data lines DL1~DLm arranged on the liquid crystal display panel 200 to a first compensation data voltage and a second compensation data voltage.

The timing controller 250 receives the image data G(n) and various control signals O-CS from the external device (not shown). The timing controller 250 includes the signal processing device 100 that compensates the image data G(n) to output the first and second compensation image data DATA (n−0.5) and DATA(n).

The timing controller 250 receives the various control signals O-CS, such as a horizontal synchronizing signal, a vertical synchronizing signal, a main clock, a data enable signal, etc., to output a first control signal CT1 and a second control signal CT2.

The first control signal CT1 serves as a signal that controls the operation of the gate driver 300 and is applied to the gate driver 300. The first control signal CT1 includes a vertical start signal that starts the operation of the gate driver 200, a gate clock signal that determines the output timing of the gate voltage, and an output enable signal that determines a pulse width of the gate voltage.

The gate driver 300 sequentially applies the gate signal to the gate lines GL1~GLn in response to the first control signal CT1 from the timing controller 250.

The second control signal CT2 serves as a signal that controls the operation of the data driver 400 and is applied to the data driver 400. The second control signal CT2 includes a horizontal start signal that starts the operation of the data driver 400, an inversion signal that inverts a polarity of the compensation data voltage, and an output indicating signal that determines the output timing of the first and second data voltages.

The data driver 400 receives the first and second compensation image data DATA(n−0.5) and DATA(n) corresponding to the pixel 210 in response to the second control signal CT2 from the timing controller 250.

The data driver 400 outputs the first compensation data voltage to the pixel unit 210 in response to the first compensation image data DATA(n−0.5) during the first sub-frame and outputs the second data voltage to the pixel unit 210 in response to the second compensation image data DATA(n) during the second sub-frame.

The pixel unit 210 displays a first sub-image pixel corresponding to the first compensation data voltage during the first sub-frame and displays a second sub-image pixel corresponding to the second compensation data voltage during the second sub-frame.

As described above, the liquid crystal display inserts the first sub-image corresponding to the first compensation data voltage DATA(n−0.5) into the present frame, so that the blurring phenomenon of the liquid crystal display panel 200 may be prevented or reduced by use of the first sub-image.

In addition, the response speed of the liquid crystal display panel 200 may be improved by using the first and second compensation data voltages DATA(n−0.5) and DATA(n) that are compensated through the dynamic capacitance compensation process.

Further, the first compensation data voltage DATA(n−0.5) is generated based on the first transposed image data TG(n−0.5) corresponding to images actually displayed on the liquid crystal display panel 200. Thus, the first compensation data voltage DATA(n−0.5) may be prevented from being over-compensated.

In FIG. 8, the liquid crystal display employing the signal processing device 100 shown in FIG. 5 has been described, however the signal processing devices shown in FIGS. 3, 6 and 7 may be applied to the liquid crystal display as the signal processing device shown in FIG. 5.

Figure 9:
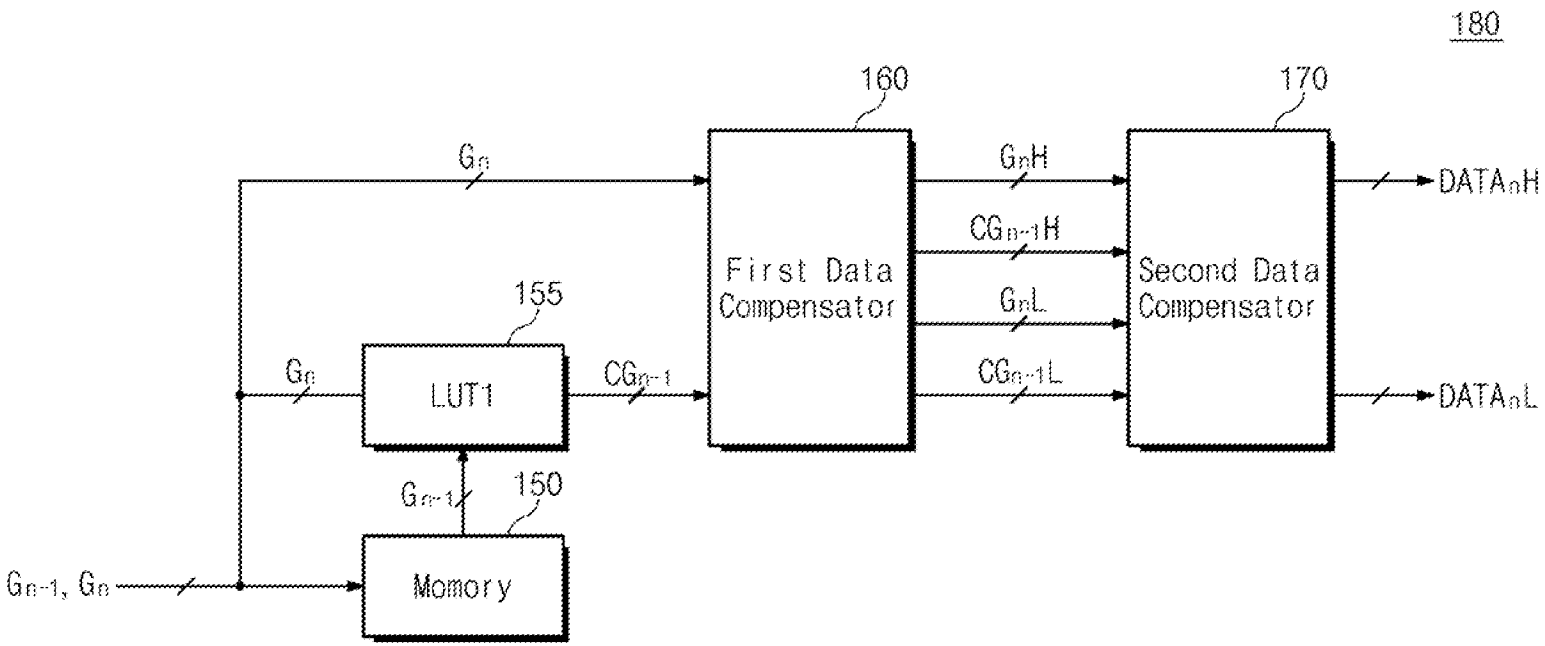
FIG. 9 is a block diagram showing another exemplary embodiment of a signal processing device.

FIG. 9 is a block diagram showing another exemplary embodiment of a signal processing device according to the present disclosure.

Referring to FIG. 9, a signal processing device 180 includes a memory 150, a look-up table 155, a first data compensator 160, and a second data compensator 170.

The memory 150 stores image data provided from the external device, such as a graphic controller, in a frame unit therein. When the present image data Gn corresponding to the present frame are applied to the memory 150, the memory 150 outputs the previous image data G'(n−1) previously stored in the memory 150. The previous image data G'(n−1) previously stored in the memory 150 may have a first target gray scale that is lower than a second target gray scale of the corresponding pixel in present image data Gn. The previous image data Gn−1 are the data provided from the external device during one to three previous frames.

The look-up table 155 stores usable reference gray scales to be used during data compensation and corresponding to images displayed on the liquid crystal display panel and obtained by combination of the first target gray scale of the previous image data Gn−1 and the second target gray scale of the present image data Gn. The reference gray scales may be empirically determined such as by having been previously adjusted, measured and/or determined by a system designer. The present image data Gn from the external device and the previous image data Gn−1 from the memory 150 are applied to the look-up table 155 as read addresses. In response, the look-up table 155 outputs the reference gray scales mapped by the present image data Gn and the previous imaged data Gn−1 as previous compensation image data CGn−1. Consequently, the first target gray scale of the previous image data Gn−1 are transposed to the reference gray scale of the previous compensation image data CGn−1 through use of the look-up table 155. One embodiment of the look-up table 155 will be described later in detail with reference to FIG. 10.

The first data compensator 160 receives the present image data Gn from the external device and the previous compensation image data Gn−1 from the look-up table 155. The first data compensator 160 changes the present image data Gn to first and second sub-image data, GnH and GnL that have the different gray scales from each other, and changes the previous compensation image data CGn−1 to third and fourth sub-image data CGn−1H and CGn−1L that have the different gray scales from each other. In the present exemplary embodiment, the first sub-image data GnH has a gray scale higher than that of the second sub-image data GnL, and the third sub-image data CGn−1H has a gray scale higher than that of the fourth sub-image data CGn−1L.

In other words, the first data compensator 160 compensates color characteristics of the present image data Gn to generate the first and second sub-image data GnH and GnL, and compensates color characteristics of the previous compensation image data CGn−1 to generate the third and fourth sub-image data CGn−1H and CGn−1L. In the present exemplary embodiment, the compensation of the color characteristics works to expand the number of the gray scale levels that may be displayed by the present image data Gn and the previous compensation image data CGn−1. To this end, the first data compensator 160 performs an adaptive color correction (ACC) process. The adaptive color correction process expands the number of discrete and selectable gray scale levels using a frame rate control (FRC) scheme without increasing of the number of bits of the present image data Gn and the previous compensation image data CGn−1. The FRC scheme can be thought of as expanding one frame into several frames. For instance, in order to generate the present image data having a 159.5 gray scale level between 159 gray scale and 160 gray scale, the present image data of 159 gray scale is assigned to a corresponding pixel in a first frame and the present image data of 160 gray scale is assigned to the corresponding pixel. As a result, since 159 gray scale and 160 gray scale are averaged in time by the human visual system, 159.5 gray scale may be visually recognized by the corresponding pixel, thereby effectively expanding the color characteristics of the present image data Gn. The color characteristics of the previous compensation image data CGn−1 may be improved by the above-described FRC scheme.

The second data compensator 170 compensates the first sub-image data GnH to first compensation image data DATAnH, and compensates the second sub-image data GnL to second compensation image data DATAnL. Thus, the response characteristics of the liquid crystal display panel may be improved by the first and second compensation image data DATAnH and DATAnL. This will be described later in detail with reference to FIGS. 11 to 13.

Figure 10:
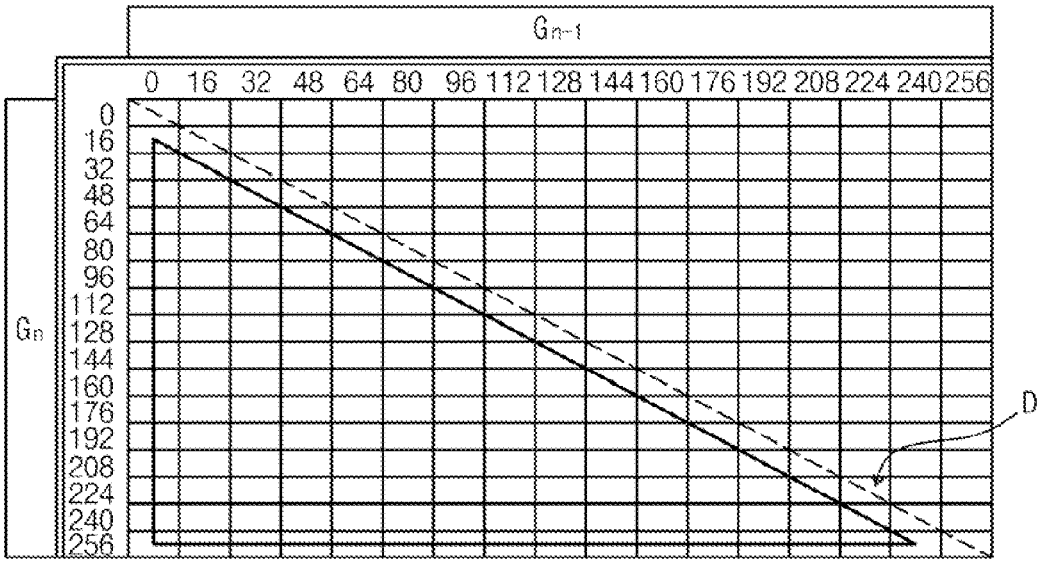
FIG. 10 is a view showing a look-up table shown in FIG. 9.

FIG. 10 is a view showing a look-up table shown in FIG. 9;

FIG. 10 shows the look-up table 155 in case that each of the present image data Gn and the previous image data Gn−1 has 4 upper-bits (MSB's). Thus, the look-up table 155 has 17 by 17 blocks of a rectangular shape.

Assuming that a total bit number of each of the present image data Gn the previous image data Gn−1 is 8, the number of lower bits (L) of each of the present image data Gn and the previous image data Gn−1 is 4 since the number of upper bits (M) of each of the present image data Gn and the previous image data Gn−1 is 4. In the present exemplary embodiment, a gray scale difference between adjacent two blocks is defined by $2^L$, so that the gray scale difference is 16 gray scales in FIG. 10. In the look-up table 155, the x-axis represents the previous image data Gn−1 and the y-axis represents the present image data Gn.

The upper-bits of the present image data Gn are equal to the upper-bits of the previous image data Gn−1 at a boundary between adjacent two blocks of the look-up table 155. In addition, the upper-bits of the present image data Gn is equal to the upper-bits of the previous image data Gn−1 in blocks through which a diagonal line D passes. Meanwhile, inside each block, the upper-bits of the present image data Gn are different from the upper-bits of the previous image data Gn−1.

The present image data Gn and the previous image data Gn−1 from the memory 150 are applied to the look-up table 155. The look-up table 155 receives the 4 upper-bit of the present image data Gn and the 4 upper-bit of the previous image data Gn−1 as the read addresses. Thus, the look-up table 155 stores reference gray scales corresponding to combinations $((2^4+1)\times(2^4+1)=17\times17)$ obtained by mapping the 4 upper-bit of the present image data Gn and the 4 upper-bit of the previous image data Gn−1. However, due to symmetry the look-up table 155 does not need to store all the reference gray scales with respect to the combinations of 17 by 17.

Unlike a conventional look-up table where the previous image data Gn−1 having a first target gray scale and the present image data Gn having the second target gray scale higher than the first target gray scale are sequentially applied, as shown in FIG. 10, the look-up table 155 stores only the reference gray scales corresponding to the blocks through which a triangular line T (below D) passes and the blocks arranged inside the triangular line T, thereby reducing the memory size for the look-up table 155.

If the previous image data Gn−1 and the present image data Gn corresponding to the blocks through which the diagonal line D passes or the blocks arranged at upper positions of the diagonal line D are applied, the first target gray scale of the previous data Gn−1 are not transposed to the reference gray scales. That is, the previous compensation image data CGn−1 output from the look-up table 155 has the same gray scale as the first target gray scale of the previous image data Gn−1.

Hereinafter, the second data compensator 170 will be described in detail with reference to FIGS. 11 to 14.

Figure 11:
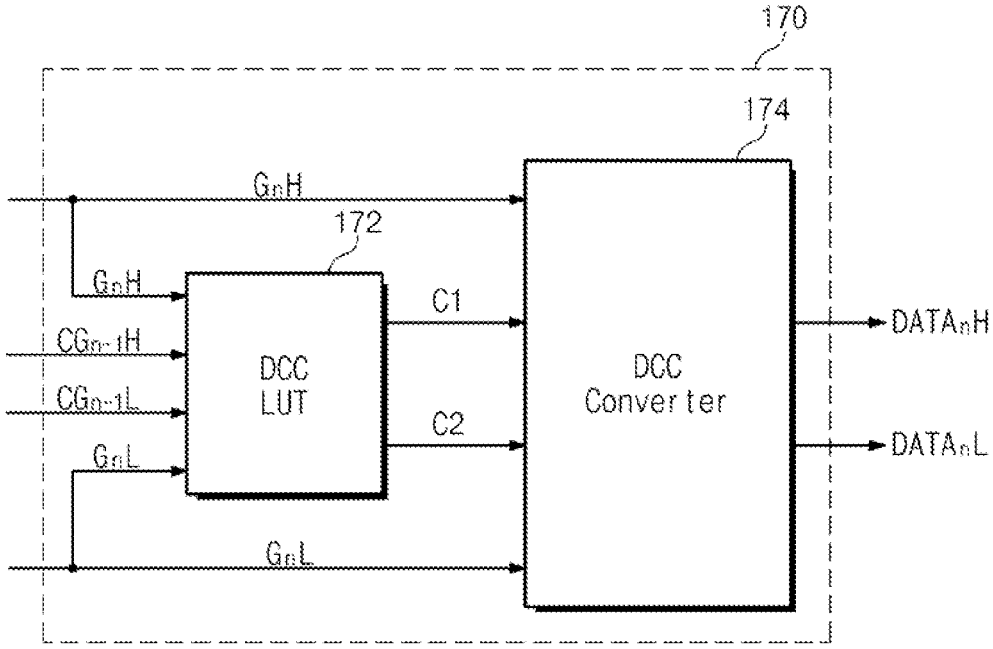
FIG. 11 is a block diagram showing an exemplary embodiment of a second data compensator shown in FIG. 9.

FIG. 11 is a block diagram showing an exemplary embodiment of a second data compensator shown in FIG. 9.

Referring to FIG. 11, the second data compensator 170 includes a DCC look-up table 172 and a DCC converter 174, The first and third sub-image data GnH and CGn−1H are applied to the DCC look-up table 172 as read addresses. Accordingly, the DCC look-up table 172 outputs a first compensation value C1 mapped by the first and third sub-image data GnH and CGn−1H.

Also, the second and fourth sub-image data GnL and CGn−1L are applied to the DCC look-up table 172 as read addresses. Thus, the DCC look-up table 172 outputs a second compensation value C2 mapped by the second and fourth sub-image data GnL and CGn−1L.

The DCC converter 174 receives the first and second sub-image data GnH and GnL from the first data compensator 160 and the first and second compensation values C1 and C2 from the DCC look-up table 172.

The DCC converter 174 adds the first compensation value C1 to the gray scale value of the first sub-image data GnH to convert the first sub-image data GnH into the first compensation image data DATAnH. Accordingly, the first compensation image data DATAnH has a gray scale value higher than that of the first sub-image data GnH. In addition, the DCC converter 174 adds the second compensation value C2 to the gray scale value of the second sub-image data GnL to convert the second sub-image data GnL into the second compensation image data DATAnL. Accordingly, the second compensation image data DATAnL has a gray scale value higher than that of the second sub-image data GnL.

Then, the first and second compensation image data DATAnH and DATAnL are applied to the driver (not shown in FIG. 11) that generates the pixel drive voltage, and the driver generates the first and second sub-voltages that have the different voltage levels from each other. In the present exemplary embodiment, the first sub-voltage has the voltage level higher than that o the second sub-voltage. The first and second sub-pixels display images having the different gray scales in response to the first and second sub-voltages. Thus, human's eyes may visually recognize an intermediate gray scale corresponding to an intermediate voltage between the first and second sequentially applied sub-voltages, thereby preventing deterioration of a side viewing angle of the liquid crystal display panel. Also, the response speed of the liquid crystal display panel may be improved by the first and second sub-voltages generated by the DCC process. Particularly, the first and second sub-voltages are generated based on the reference gray scales corresponding to images displayed on the liquid crystal display panel in lieu of the first target gray scale of the previous image data Gn−1. Thus, the liquid crystal display panel may prevent the voltages applied thereto within the present frame from being over-compensated.

Meanwhile, although the first target gray scale of the previous image data Gn−1 is transposed to the reference gray scale, the second sub-voltage corresponding to the second compensation image data DATAnL may be over-compensated. For instance, it is assumed that the previous image data Gn−1 of zero gray scale and the present image data Gn of 160 gray scales are sequentially applied with respect to a specific pixel, and it is assumed that 43 reference gray scales mapped by the previous image data Gn−1 of zero gray scale and the present image data Gn of 160 gray scales are stored into the look-up table 155 shown in FIG. 9. Thus, the previous image data Gn−1 of zero gray scale are converted into the previous compensation image data CGn−1 of 43 gray scales through the look-up table 155. That is, the zero gray scale of the previous image data Gn−1 is transposed to 43 gray scales. Then, the previous compensation image data CGn−1 of 43 gray scales are converted into the third sub-image data CGn−1H having the gray scale higher than 43 gray scales and the fourth sub-image data CGn−1L having the gray scale lower than 43 gray scales through the first data compensator 160. When the gray scale of the fourth sub-image data CGn−1L is set to zero gray scale lower than the 43 gray scales, only the third sub-image data CGn−1H are transposed since the fourth sub-image data CGn−1L has the gray scale equal to that of the previous image data Gn−1. Consequently, the second sub-voltage generated by the second and fourth sub-image data GnL and CGn−1L is over-compensated. Accordingly, in the signal processing device shown in FIGS. 9 to 11, accurate data processing should be required with respect to the fourth sub-image data CGn−1L having the gray scale lower than that of the third sub-image data CGn−1H.

Hereinafter, a second data compensator according to another exemplary embodiment of the present disclosure, which is capable of accurately processing the fourth sub-image data CGn−1L, will be described.

In the second data compensator that will be described hereinafter, the compensation rate of the second sub-image data GnL compensated by the DCC process using the second and fourth sub-image data GnL and CGn−1L is lower than the compensation rate of the first sub-image data GnH compensated by the DCC process using the first and third sub-image data GnH and CGn−1H. To this end, the second data compensator will be described with reference to look-up tables each of which includes a combination of the first and third sub-image data GnH and CGn−1H and a combination of the second and fourth sub-image data GnL and CGn−1L, which are different from each other.

Figure 12:
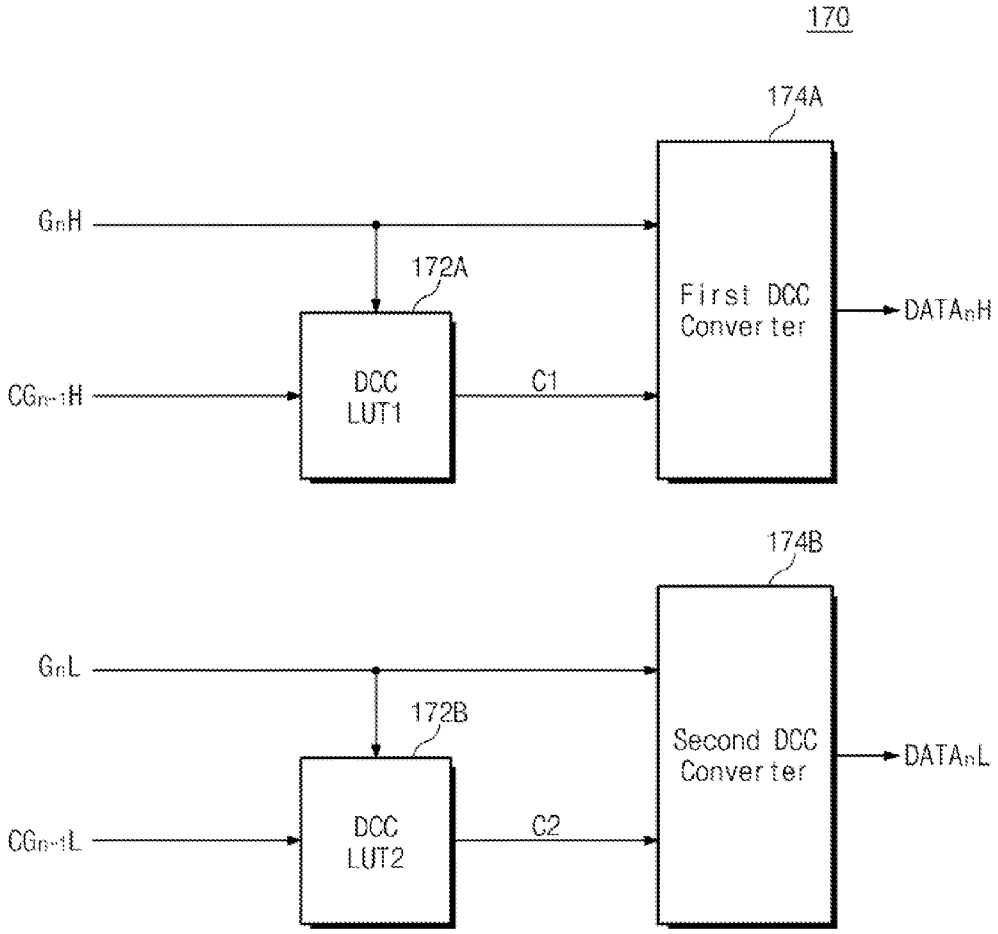
FIG. 12 is a block diagram showing another exemplary embodiment of a second data compensator shown in FIG. 9.

FIG. 12 is a block diagram showing another exemplary embodiment of a second data compensator shown in FIG. 9.

Referring to FIG. 12, the second data compensator 170 includes a first DCC look-up table 172A, a second DCC look-up table 172B, a first DCC converter 174A, and a second DCC converter 174B.

The first DCC look-up table 172A previously stores a plurality of compensation values added to the gray scales of the first sub-image data GnH therein. The first and third sub-image data GnH and CGn−1H are applied to the first DCC look-up table 172A from the first data compensator 160 as the read addresses. Accordingly, the first compensation value C1 mapped by the first and third sub-image data GnH and CGn−1H is output from the first DCC look-up table 172A.

The first DCC converter 174A receives the first sub-image data GnH from the first data compensator 160 and the first compensation value C1 from the first DCC look-up table 172A. The first DCC converter 174A adds the first compensation value C1 to the gray scale of the first sub-image data GnH to generate the first compensation image data DATAnH having the reference gray scale higher than that of the first sub-image data GnH.

The second DCC look-up table 172B previously stores a plurality of second compensation values added to the gray scales of the second sub-image data GnL. The second and fourth sub-image data GnL and CGn−1L from the first data compensator 160 are applied to the second DCC look-up table 172B as the read addresses. Accordingly, the second compensation value C2 mapped by the second and fourth sub-image data GnL and CGn−1L is output from the second DCC look-up table 172B. In the present exemplary embodiment, the second compensation values C2 stored in the second DCC look-up table 172B are smaller than the first compensation values C1 stored in the first DCC look-up table 172A. Thus, the compensation rate of the second sub-image data GnL by the second compensation value C2 is smaller than the compensation rate of the first sub-image data GnH by the first compensation value C1.

The second DCC converter 174B receives the second sub-image data GnL from the first data compensator 160 and the second compensation value C2 from the second DCC look-up table 172B. The second DCC converter 174B adds the second compensation value C2 to the gray scale of the second sub-image data GnL to generate the second compensation image data DATAnL having the gray scale higher than that of the second sub-image data GnL.

As described above, the second data compensator 170 shown in FIG. 12 refers to the second DCC look-up table 172B having the combination of the second and fourth sub-image data CGnL and CGnL−1L lower than that of the first DCC look-up table 172A. Thus, the second sub-image data CGnL may be prevented from being over-compensated by the fourth sub-image data CGn−1L that are not normally transposed.

Hereinafter, a second data compensator 170 according to another exemplary embodiment of the present disclosure will be described. In the present exemplary embodiment, the second data compensator 170 applies a low compensation rate to specific combinations of all combinations of the second and fourth sub-image data CGnL and CGn−1L, which will be over-compensated.

Meanwhile, as the difference between the gray scales of the second sub-image data CGnL and the gray scales of the fourth sub-image data CGn−1L increases, the second compensation value C2 for the second DCC look-up table 172B increases, so that the probability that the specific combinations of the second and fourth sub-image data CGnL and CGn−1L are over-compensated becomes higher. Accordingly, as shown in FIG. 14, the specific combinations having high probability of the over-compensation are arranged in a left lower side area SA of the second DCC look-up table 172B.

Figure 13:
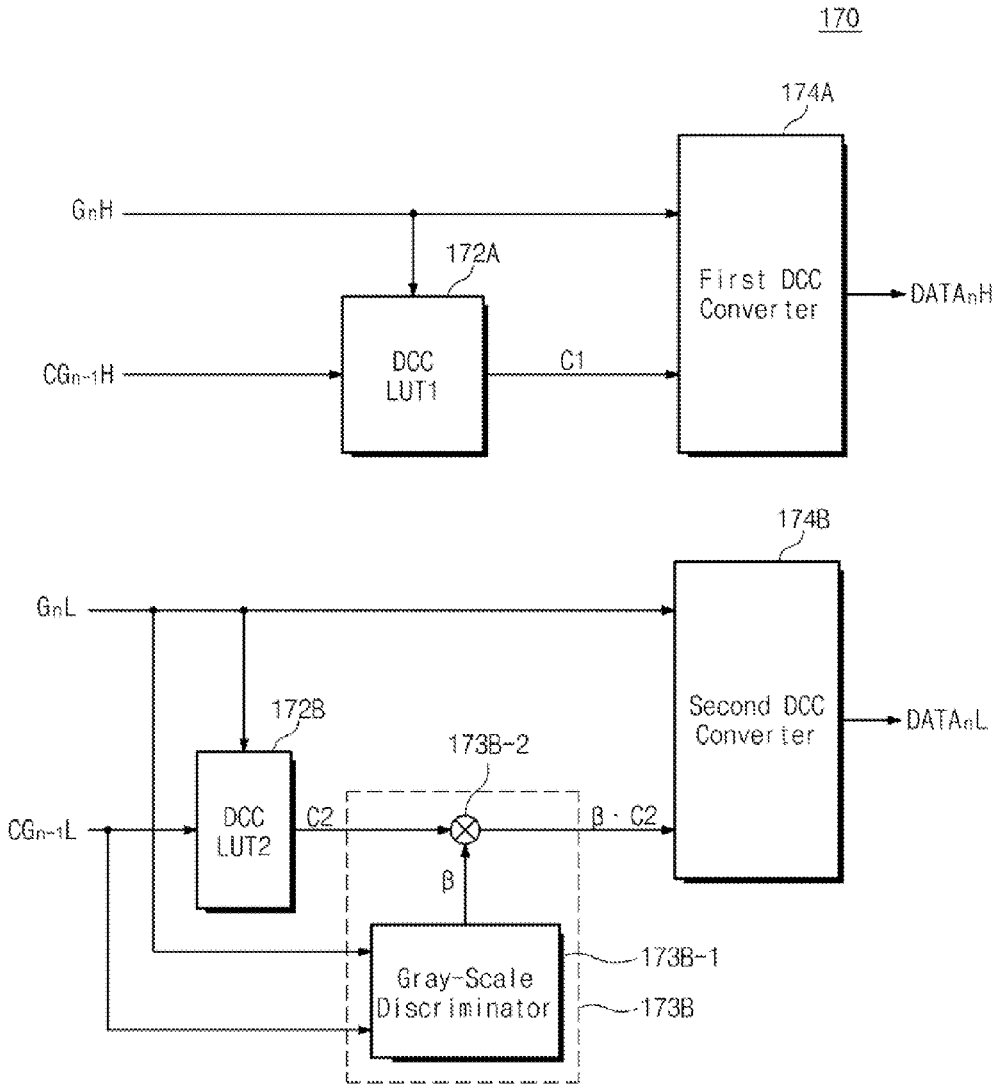
FIG. 13 is a block diagram showing another exemplary embodiment of a second data compensator shown in FIG. 9.
Figure 14:
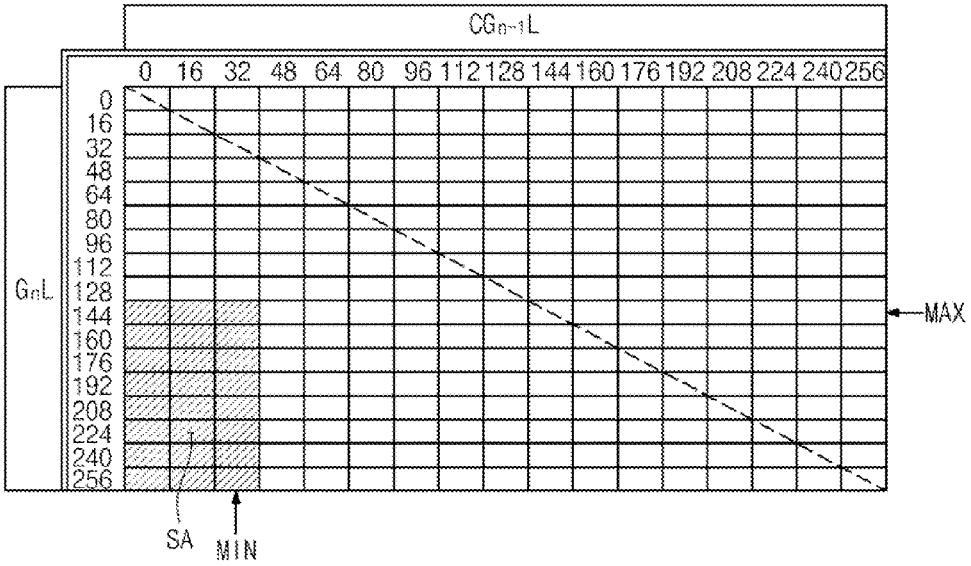
FIG. 14 is a view showing a gray scale region to which predetermined variables are applied in a second dynamic capacitance compensation look-up table shown in FIG. 13.

FIG. 13 is a block diagram showing another exemplary embodiment of a second data compensator shown in FIG. 9, and FIG. 14 is a view showing a gray scale region to which predetermined variables are applied in a second dynamic capacitance compensation look-up table shown in FIG. 13. In FIG. 13, the same reference numerals denote the same elements in FIG. 12, and thus the detailed descriptions of the same elements will be omitted.

Referring to FIG. 13, the second data compensator 170 includes first and second look-up tables 172A and 172B, first and second DCC converters 174A and 174B, and a calculator 173B. In the present exemplary embodiment, first and second look-up tables 172A and 172B and first and second DCC converters 174A and 174B have the same functions and structures as those of FIG. 12, and thus their detailed descriptions will be omitted.

The calculator 173B outputs a predetermined variable (β) in consideration of the gray scales of the second sub-image data GnL and the fourth sub-image data CGn−1L.

The calculator 173B includes a gray-scale discriminator 173B-1 and a multiplier 173B-2. In case that the second sub-image data GnL has a first gray scale and the fourth sub-image data CGn−1L has a second gray scale lower than the first gray scale, the gray-scale discriminator 173B-1 generates and outputs the predetermined variable (β). The first and second gray scales are empirically predetermined by experimentation. The first gray scale is within the range of 144 to 256, and the second gray scale is within the range of 0 to 32. The multiplier 173B-2 multiplies the second compensation value C2 from the second DCC look-up table 172B by the predetermined variable (β) from the gray-scale discriminator 173B-1 to generate a third compensation value (β×C2). In the present exemplary embodiment, the predetermined variable (β) is larger than zero and smaller than 1 (0<β<).

Consequently, the second data compensator 173B does not apply the predetermined variable (β) to all the second compensation values C2 output from the second DCC look-up table 172B. That is, the predetermined variable (β) is applied to only the second compensation values C2 from the blocks arranged in an area shaded by oblique-lines of the second DCC look-up table 172B shown in FIG. 14. Thus, the response speed of the liquid crystal display panel may be prevented from being deteriorated by the second compensation values C2 from the second DCC look-up table 172B.

Figure 15:
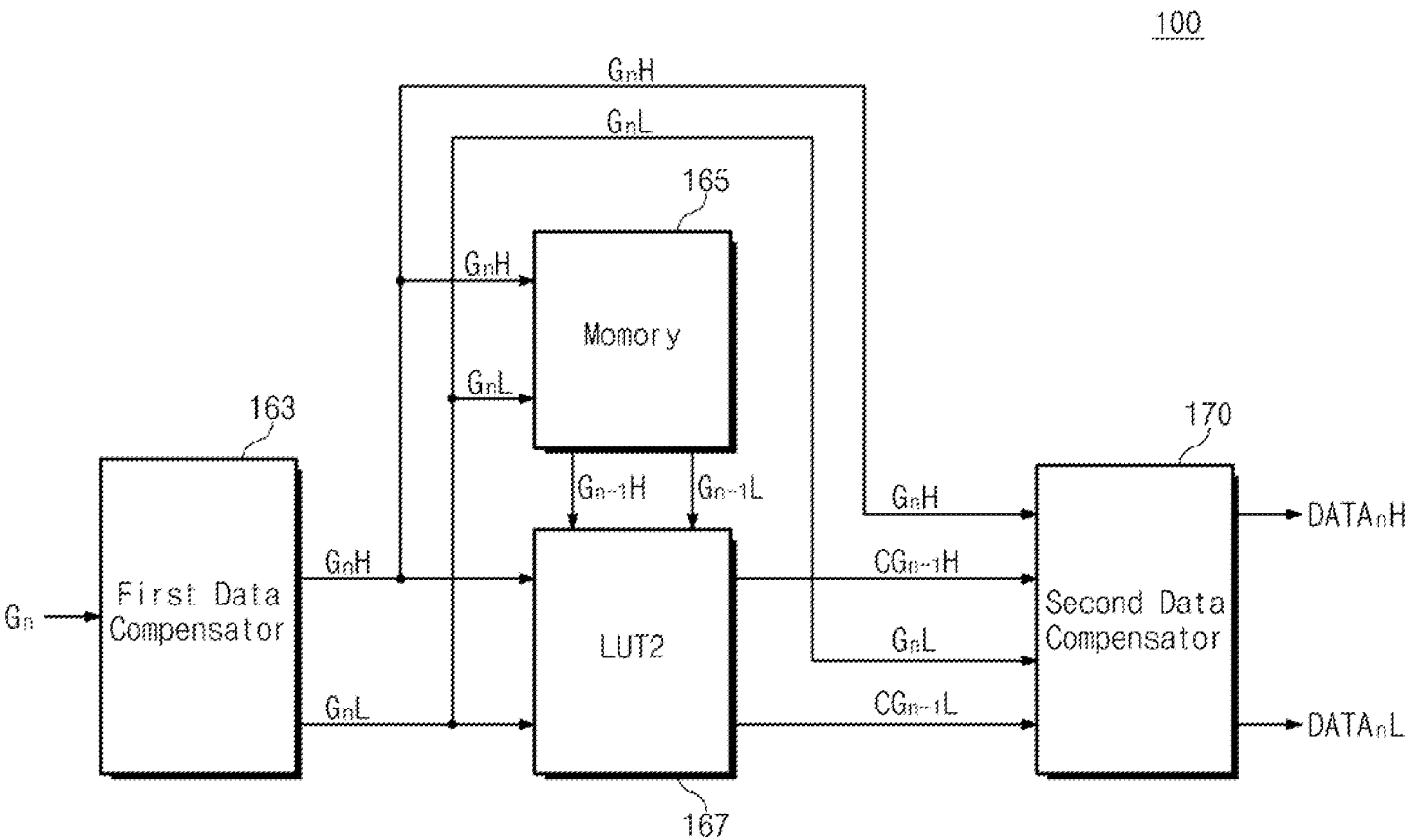
FIG. 15 is a block diagram showing another exemplary embodiment of a signal processing device according to the present disclosure.

FIG. 15 is a block diagram showing another exemplary embodiment of a signal processing device according to the present disclosure.

Referring to FIG. 15, a signal processing device 100 according to another exemplary embodiment of the present disclosure includes a first data compensator 163, a memory 165, a look-up table 167, and a second data compensator 170.

The first data compensator 163 receives image data provided from an external device for every frame and converts the image data into first and second sub-image data GnH and GnL each having different gray-scales.

The memory 165 stores the first and second sub-image data GnH and GnL that are sequentially provided from the first data compensator 163. When the first and second sub-image data GnH and GnL (hereinafter, referred to as first and second present sub-image data) corresponding to the present frame are input to the memory 165, first and second sub-image data Gn−1H and Gn−1L (hereinafter, referred to as first and second previous sub-image data) corresponding to the previous frame are output from the memory 165.

The look-up table 167 stores a plurality of gray scales. The first present sub-image data GnH from the first data compensator 163 and the first previous sub-image data Gn−1H from the memory 165 are applied to the look-up table 165 as read addresses. Accordingly, look-up table 167 outputs gray scales mapped by the first present sub-image data GnH and the first previous sub-image data Gn−1H as a first previous compensation sub-image data CGn−1H. The gray scales mapped by the first present sub-image data GnH and the first previous sub-image data Gn−1H correspond to the gray scales that are actually displayed on the liquid crystal display panel by combinations of the first present sub-image data GnH and the first previous sub-image data Gn−1H.

Similarly, when the second present sub-image data GnL from the first data compensator 163 and the second previous sub-image data Gn−1L from the memory 165 are applied to the look-up table 167, the look-up table 167 outputs gray scales mapped by the second present sub-image data GnL and the second previous sub-image data Gn−1L as a second previous compensation sub-image data CGn−1L.

The second data compensator 170 compares the first present sub-image data GnH from the first data compensator 163 with the first previous compensation sub-image data CGn−1H from the look-up table 167 to convert the first present sub-image data GnH into a third present sub-image data DATAnH. In addition, the second data compensator 170 compares the second present sub-image data GnL from the first data compensator 163 with the second previous compensation sub-image data CGn−1L from the look-up table 167 to convert the second present sub-image data GnL into a fourth present sub-image data DATAnL.

Figure 16:
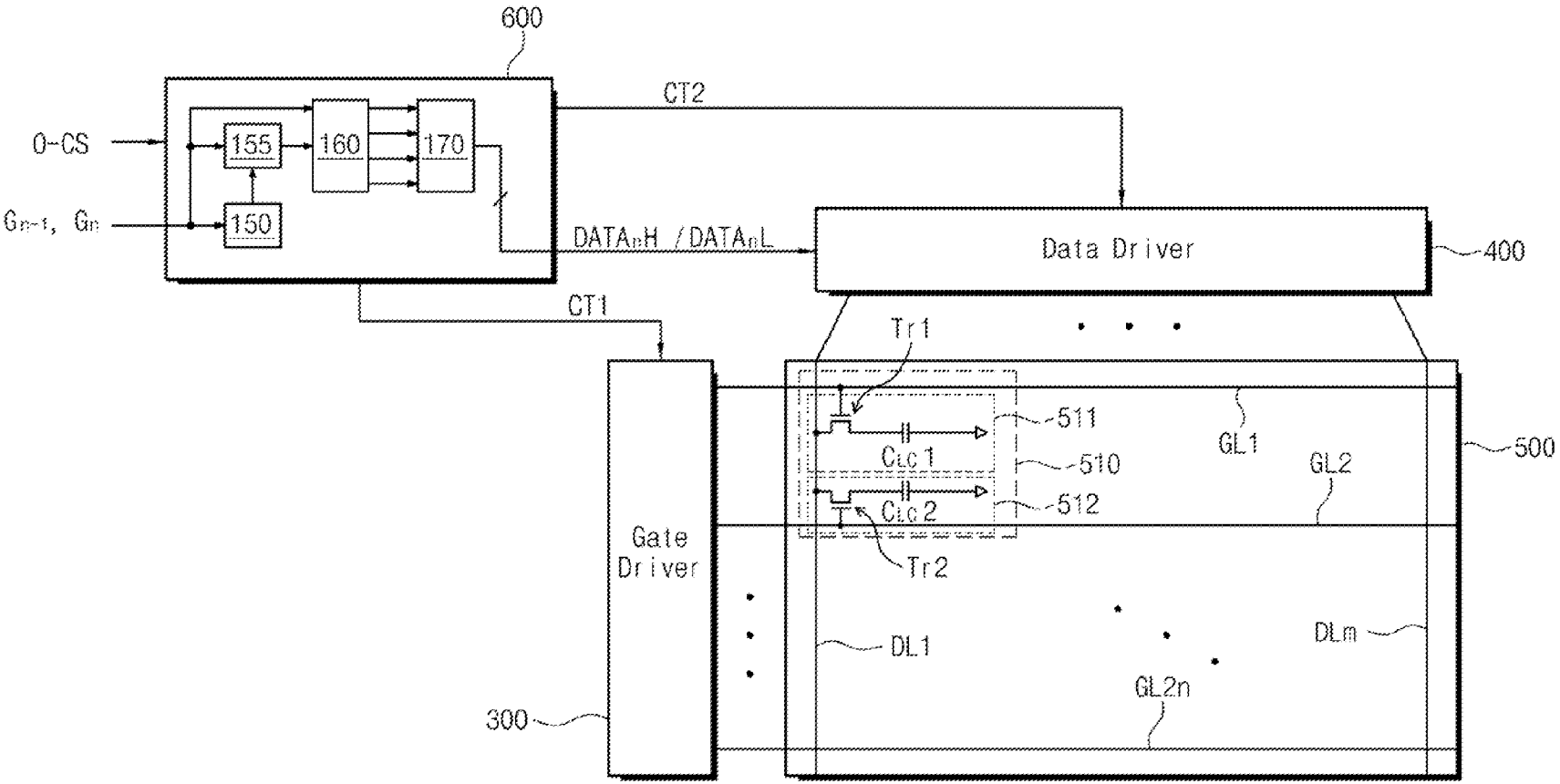
FIG. 16 is a block diagram showing another exemplary embodiment of a liquid crystal display according to the present disclosure.

FIG. 16 is a block diagram showing another exemplary embodiment of a liquid crystal display employing the signal processing device of FIG. 9. In FIG. 16, the same reference numerals denote the same elements of FIG. 9, and thus the detailed description of the same elements will be omitted.

Referring to FIG. 16, a liquid crystal display includes a display unit 500, a gate driver 300, a data driver 400, and a timing controller 600.

The display unit 500 includes a plurality of gate lines GL1~GL2*n* to which a gate voltage is applied, a plurality of data lines DL1~DLm to which a data voltage is applied, and a plurality of pixel areas defined by the gate lines GL1~GL2*n* and the data lines DL1~DLm in a matrix form. Each pixel area includes a pixel unit 510 including a first sub-pixel unit 511 and a second sub-pixel unit 512. The first sub-pixel unit 511 includes a first thin film transistor Tr1 and a liquid crystal capacitor CLC1, and the second sub-pixel unit 512 includes a second thin film transistor Tr2 and a second liquid crystal capacitor CLC2.

The gate driver 300 is electrically connected to the gate lines GL1~GL2*n* arranged on the display unit 500 to apply the gate voltage to the gate lines GL1~GL2*n*. The data driver 400 is electrically connected to the data lines DL1~DLm arranged on the display unit 500 to apply a first or second data voltage to the data lines DL1~DLm.

The timing controller 600 receives the image data Gn and various control signals O-CS from the external device such as graphic controller. The timing controller 600 includes the signal processing device 180 that compensates the image data Gn to output the third present sub-image data DATAnH and the fourth present sub-image data DATAnL as a first compensation image data DATAnH and a second compensation image data DATAnL, respectively. Also, the timing controller 600 outputs a first control signal CT1 and a second control signal CT2 in response to the various control signal O-CS, for example a vertical synchronizing signal, a horizontal synchronizing signal, a main clock, a data enable signal, etc.

The first control signal CT1 serves as a signal to control the operation of the gate driver 300 and is applied to the gate driver 300. The first control signal CT1 includes a vertical start signal that starts the operation of the gate driver 300, a gate clock signal that determines the output timing of the gate voltage, and an output enable signal that determines a pulse width of the gate voltage.

The gate driver 300 sequentially applies the gate voltage to the gate lines GL1~GLn in response to the first control signal CT1 from the timing controller 600.

The second control signal CT2 serves as a signal that controls the operation of the data driver 400 and is applied to the data driver 400. The second control signal CT2 includes a horizontal start signal that starts the operation of the data driver 400, an inversion signal that inverts a polarity of the compensation data voltage, and an output indicating signal that determines the output timing of the first and second data voltages.

The data driver 400 receives the first and second compensation image data DATAnH and DATAnL corresponding to the pixels corresponding to one row in response to the second control signal CT2 from the timing controller 600.

The data driver 400 outputs the first compensation image data DATAnH as a first data voltage during a first period in which the first sub-pixel unit 511 is driven, and the data driver 400 outputs the second compensation image data DATAnL as a second data voltage during a second period in which the second sub-pixel unit 512 is driven. The first data voltage is higher than the second data voltage.

As described above, the image data Gn are converted into the first and second sub-image data GnH and GnL, and the first and second sub-image data GnH and GnL are compensated to the first and second compensation data DATAnH and DATAnL. Accordingly, the first and second compensation image data DATAnH and DATAnL may be applied to the first and second sub-pixel units 511 and 512, respectively, thereby preventing over gray scales from being applied to the first and second sub-pixels 511 and 512.

In addition, when the first and second data voltages are applied to the first and second sub-pixels 511 and 512, respectively, the first and second sub-pixels are represented in different brightness. That is, the brightness of the first sub-pixel 511 is higher than the brightness of the second sub-pixel 512 even though the first and second sub-pixels 511 and 512 are represented in the same gray scale. In this case, human's eyes may visually recognize an intermediate gray scale corresponding to an intermediate voltage between the first and second data voltages, thereby preventing a side viewing angle of the liquid crystal display panel from being deteriorated by quantization distortion of a gamma curve at gray scales lower than the intermediate gray scale.

According to the above, the blurring phenomenon of the liquid crystal display panel may be prevented by the first sub-image inserted into the present frame.

In addition, the response speed of the liquid crystal display panel may be improved by using the first and second compensation image data that are compensated by the dynamic capacitance compensation process.

Further, the first compensation image data are generated based on the first and second transposed image data corresponding to images displayed on the liquid crystal display panel, so that the first compensation image data may be prevented from being over-compensated.

Although the exemplary embodiments have been described, it is understood that the present disclosure of invention should not be limited to these exemplary embodiments but various changes and modifications can be made by one ordinary skilled in the art after having read the disclosure where the changes are within the spirit and scope of the present disclosure as herein provided.

The claims in this application are different from those of the application(s) from which priority is claimed. Applicant rescinds any disclaimer of claim scope made in the related application(s) and requests that any previous disclaimer and previously cited references be revisited. Further, any disclaimer made in the instant application is not intended to be read into the predecessor application(s).

What is claimed is:

1. A signal processing device for use in a liquid crystal display panel, the signal processing device comprising:

a motion interpolator that determines a motion vector of a prespecified movable image object within supplied image data, wherein the motion interpolator determines the motion vector by using previous image data associated with a previous frame and present image data associated with a present frame, and wherein the motion interpolator generates intermediate image data for an interpolated intermediate image frame based on the determined motion vector;

a look-up table that stores a plurality of predetermined transposition values, the predetermined transposition values being usable to transpose target gray scale data obtained from the interpolation-produced intermediate image frame into a first reference gray scale based on a combination of the previous image data and the intermediate image data, wherein in response to receipt of the previous image data and the intermediate image data, the lookup table outputs a first transposed image data;

a memory operatively coupled to store the present image data and the first transposed image data and to sequentially output the first transposed image data and the present image data during the present frame; and a data compensator that receives the first transposed image data and the present image data from the memory, compensates the first transposed image data to thereby generate a first compensation image data, compensates the present image data to generate a second compensation image data, and thereby compensates for slow response characteristics of the liquid crystal display panel based on the first and second compensation image data, wherein the present frame comprises a first sub-frame and a second sub-frame that are successive displayed in time, and the memory outputs the first transposed image data during the first sub-frame and outputs the present image data during the second sub-frame, and wherein the look-up table receives the present image data, transposes a gray scale of the present image data into a second reference gray scale based on the combination of the present image data and the intermediate image data, and outputs the second reference gray scale as a second transposed image data.

2. The signal processing device of claim 1, wherein the second reference gray scale corresponds to a gray scale that is displayed on the liquid crystal display panel based on the present image data.

3. The signal processing device of claim 1, wherein the memory is operatively coupled to store the second transposed image data and the intermediate image data therein, and is configured to output the intermediate image data during the first sub-frame, and to output the second transposed image data during the second sub-frame.

4. The signal processing device of claim 3, wherein the data compensator receives the intermediate image data and the second transposed image data from the memory, compensates the intermediate image data to thereby generate the first compensation image data, compensates the second transposed image data to thereby generate the second compensation image data, and thereby compensates for the slow response characteristics of the liquid crystal display panel based on the first and second compensation image data.

5. A liquid crystal display comprising:

a signal processing device that receives a previous image data of a previous frame and a present image data of a present frame and sequentially outputs a first compensation image data and a second compensation image data;

a data driver that outputs a first compensation data voltage in response to the first compensation image data during a first sub-frame of the present frame and outputs a second compensation data voltage in response to the second compensation image data during a second sub-frame of the present frame;

a gate driver that outputs a gate signal; and a liquid crystal display panel that sequentially displays a first sub-image corresponding to the first compensation data voltage and a second sub-image corresponding to the second compensation data voltage in response to the gate signal, wherein the signal processing device comprises:

a motion interpolator that calculates a motion vector using the previous image data of the previous frame and the present image data of the present frame and generates an intermediate image data based on the motion vector;

a look-up table that stores a plurality of reference gray scales, transposes a target gray scale of the intermediate image data into a first reference gray scale based on a combination of the previous image data and the intermediate image data, and outputs the first reference gray scale as a first transposed image data, the first reference gray scale corresponding to an image displayed on the liquid crystal display panel by the intermediate image data; a memory that stores the present image data and the first transposed image data and sequentially outputs the first transposed image data and the present image data during the present frame; and a data compensator that receives the first transposed image data and the present image data from the memory, compensates the first transposed image data to generate the first compensation image data, compensates the present image data to generate the second compensation image data, and compensates response characteristics of the liquid crystal display panel based on the first and second compensation image data, wherein the present frame comprises the first sub-frame and the second sub-frame that are successive in time, and the memory outputs the first transposed image data during the first sub-frame and outputs the second transposed image data during the second sub-frame, and wherein the look-up table receives the present image data, transposes the gray scale of the present image data into a second reference gray scale based on the combination of the present image data and the intermediate image data, and outputs the second reference gray scale as a second transposed image data.

6. The liquid crystal display of claim 5, wherein the second reference gray scale corresponds to a gray scale that is displayed on the liquid crystal display panel based on the present image data.

7. The liquid crystal display of claim 5, wherein the memory stores the second transposed image data and the intermediate image data therein, outputs the intermediate image data during the first sub-frame, and outputs the second transposed image data during the second sub-frame.

8. The liquid crystal display of claim 7, wherein the data compensator receives the intermediate image data and the second transposed image data from the memory, compensates the intermediate image data to generate the first compensation image data, compensates the second transposed image data to generate the second compensation image data, and compensates the response characteristics of the liquid crystal display panel based on the first and second compensation image data.

* * * * *